US006604503B2

(12) United States Patent
Mekler

(10) Patent No.: US 6,604,503 B2
(45) Date of Patent: Aug. 12, 2003

(54) ROTARY MACHINE

(75) Inventor: Dan Mekler, Jerusalem (IL)

(73) Assignee: M.R. Engines Ltd., Haifa (IL)

( * ) Notice: Subject to any disclaimer, the term of this patent is extended or adjusted under 35 U.S.C. 154(b) by 0 days.

(21) Appl. No.: 09/887,060

(22) Filed: Jun. 25, 2001

(65) Prior Publication Data

US 2001/0043876 A1 Nov. 22, 2001

Related U.S. Application Data

(63) Continuation-in-part of application No. 09/099,521, filed on Jun. 18, 1998, now Pat. No. 6,250,278.

(30) Foreign Application Priority Data

Jun. 15, 1998 (IL) ..... 124923

(51) Int. Cl.[7] ..... F02B 53/00

(52) U.S. Cl. ..... 123/241; 123/246; 418/191; 418/204

(58) Field of Search ..... 123/241, 246, 123/244; 418/191, 196, 204, 206.4, 206.5

(56) References Cited

U.S. PATENT DOCUMENTS

| | | | | | |
|---|---|---|---|---|---|
| 1,240,112 | A | * | 9/1917 | Winger | 123/246 |
| 1,294,869 | A | * | 2/1919 | Bump | 418/206.4 |
| 1,656,538 | A | * | 1/1928 | Smith | 123/246 |
| 1,751,843 | A | * | 3/1930 | Rosett | 418/191 |
| 2,453,284 | A | * | 11/1948 | Törnborg | 418/204 |
| 2,845,909 | A | | 8/1958 | Pitkanen | |
| 3,078,807 | A | | 2/1963 | Thompson | |
| 3,726,617 | A | | 4/1973 | Daido | |
| 3,929,402 | A | * | 12/1975 | Schubert | 123/246 |
| 4,080,935 | A | * | 3/1978 | Olson | 123/244 |
| 4,152,100 | A | * | 5/1979 | Poole et al. | 418/196 |
| 4,506,637 | A | * | 3/1985 | Reinhold | 123/246 |
| 4,666,383 | A | | 5/1987 | Mendler, III | |
| 4,677,950 | A | * | 7/1987 | Buske | 123/241 |

(List continued on next page.)

FOREIGN PATENT DOCUMENTS

| | | | |
|---|---|---|---|
| DE | 696 469 | C | 8/1940 |
| DE | 2323592 | | 1/1974 |
| DE | 2412888 | * | 10/1975 |
| DE | 24 22 966 | A | 11/1975 |
| DE | 44 39 942 | A1 | 5/1996 |
| FR | 2690201 | | 4/1992 |
| GB | 2018899 | | 10/1979 |

OTHER PUBLICATIONS

*Popular Science*, May 1994, p. 46, "Wheeze–Free Rotary".
*Popular Science*, Aug. 1983, pp. 47–50, "The Wankel takes off".
*Popular Science*, Apr. 1983, p. 83, "Smokey's Phase I" diagram.

(List continued on next page.)

*Primary Examiner*—Thomas Denion
*Assistant Examiner*—Tu M. Nguyen
(74) *Attorney, Agent, or Firm*—Nixon & Vanderhye P.C.

(57) ABSTRACT

A rotary machine in which plural, non-cylindrical rotors are provided for rotation within partially overlapping cylindrical bores, formed within a machine housing. Each rotor each said rotor has a curved outer surface formed of a plurality of contiguous mutually tangential curved portions.* The rotors are eccentrically mounted for synchronized, same directional rotation, within their respective bores, and each is arranged to alternately provide intake and exhaustion of working gaseous fluids, such that each rotor is continually either admitting or exhausting a working gas. The machine is constructed such that the rotors are cylindrical, each being of internally balanced form. The rotors do not touch each other or any portion of the machine casing at any time, while being positioned so as to define minimal gaps therebetween. A high rotational speed may be developed, thereby obviating the need for seals entirely, and thus further increasing the available speed, and thus the work efficiency of the machine.

21 Claims, 20 Drawing Sheets

U.S. PATENT DOCUMENTS

| | | | | | |
|---|---|---|---|---|---|
| 4,901,694 | A | * | 2/1990 | Sakita | 123/234 |
| 5,152,683 | A | | 10/1992 | Signorelli | |
| 5,222,992 | A | * | 6/1993 | Fleischmann | 123/213 |
| 5,341,782 | A | * | 8/1994 | McCall et al. | 123/246 |
| 5,466,138 | A | * | 11/1995 | Gennaro | 418/191 |
| 5,568,796 | A | * | 10/1996 | Palmer | 418/235 |
| 5,898,256 | A | * | 4/1999 | Ide et al. | 310/344 |
| 5,992,230 | A | * | 11/1999 | Scarpa et al. | 418/206.5 |
| 6,250,278 | B1 | * | 6/2001 | Mekler | 123/241 |

OTHER PUBLICATIONS

*Popular Science*, Apr. 1984, pp. 78–80, "Detroit's big switch to Turbo Power".

*Popular Science*, Feb. 1987, pp. 74–76, "Can the two–stroke make it this time?".

*Popular Science*, Jun., 1994, p. 96, "Where the Energy Goes".

*Popular Science*, Apr., 1985, p. 89, "Saylon—super–strong ceramic for engines, tools".

*Popular Science*, Mar. 1982, pp. 64–66, "A family of heat–resistant, super–tough ceramics can deliver big fuel savings".

*Popular Science*, Dec. 1982, pp. 54–56, "From Japan's labs: Ceramic Diesels".

* cited by examiner

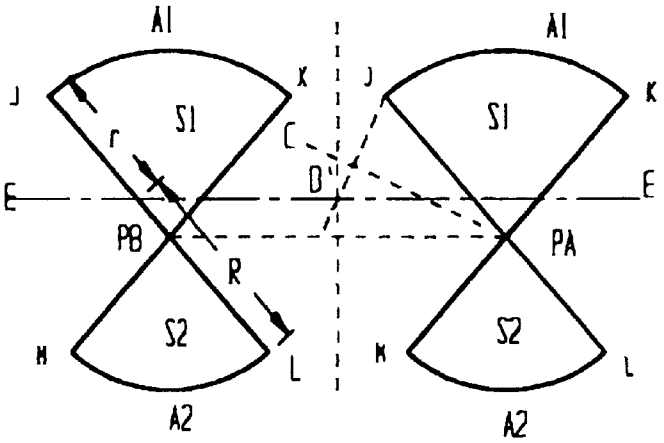
Fig 6B
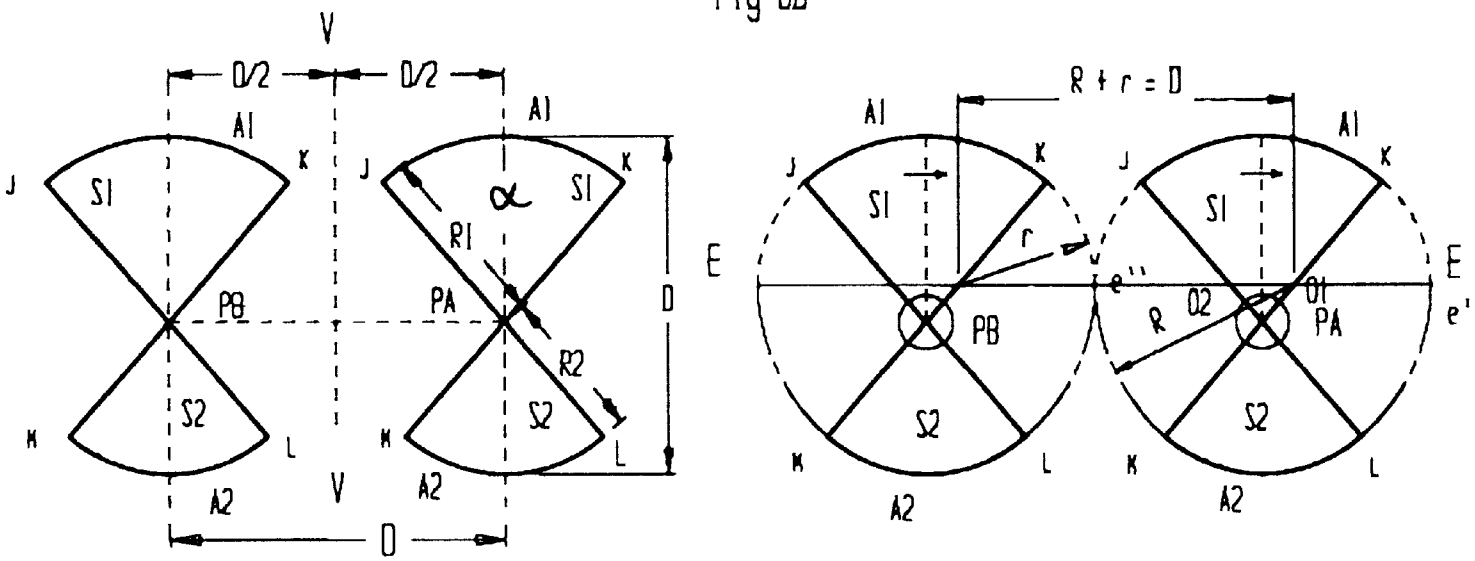
Fig 7
Fig 6A

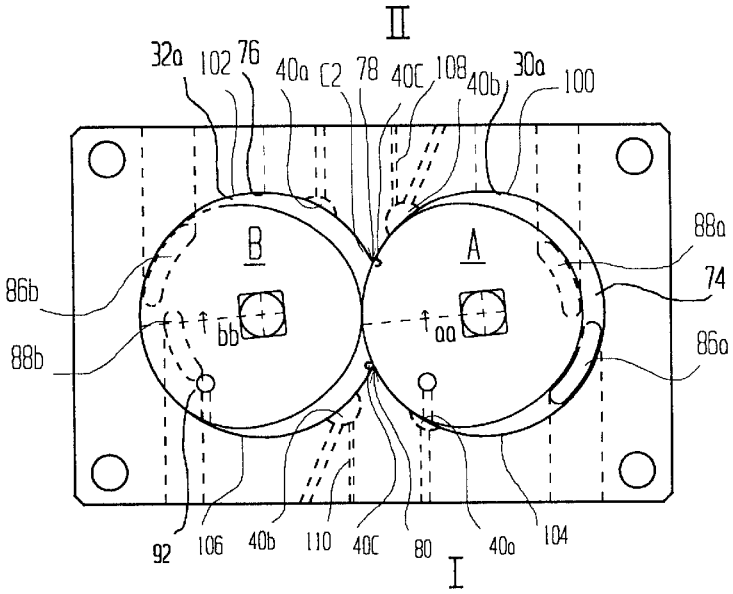
Fig 12 A
Fig 12 B
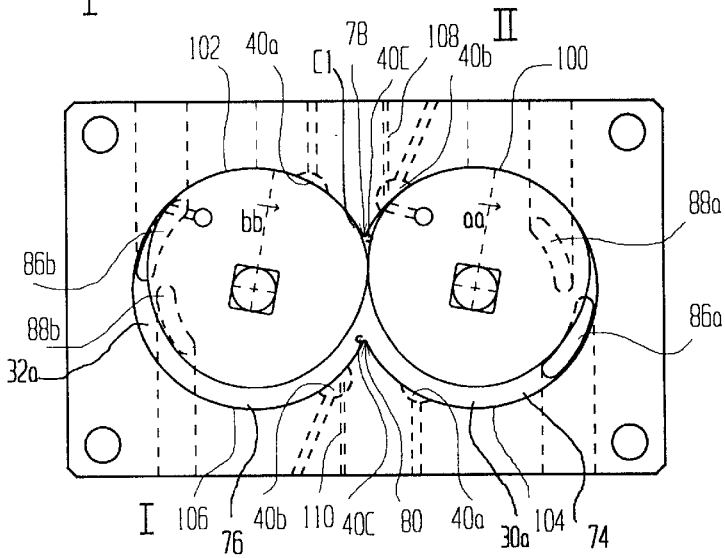
Fig 12 C
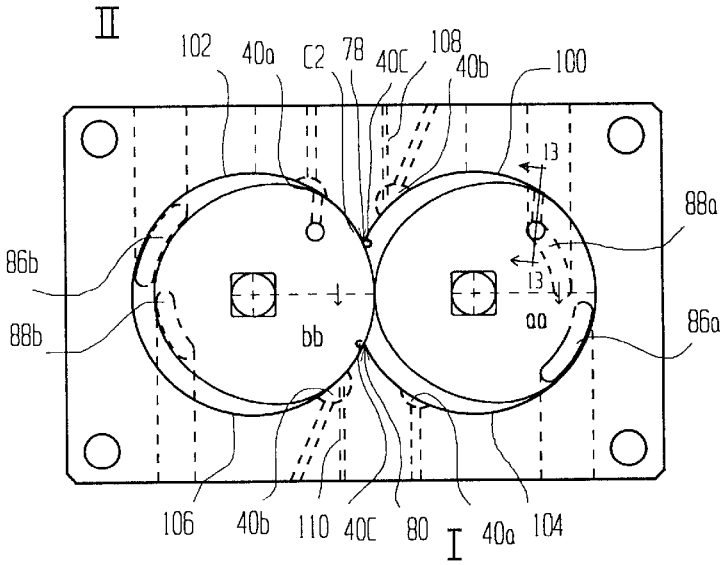

ROTARY MACHINE

REFERENCE TO RELATED APPLICATIONS

The present application is a continuation-in-part of U.S. Ser. No. 09/099,521 entitled Rotary Machine, filed on Jun. 18, 1998, now U.S. Pat. No. 6,250,278, the contents of which is incorporated herein, by reference.

FIELD OF THE INVENTION

The present invention relates to rotary machines, including rotary engines, rotary motors, and compressors.

BACKGROUND OF THE INVENTION

The advent of rotary engines was intended to supplant reciprocating engines, thereby to reduce energy losses caused by the reciprocation of pistons, to reduce the number of moving parts, and also, friction losses. In this way it was intended to increase the number of revolutions per minute, and also to increase engine efficiency.

Rotary engines may include a pair of rotors arranged for rotation within a sealed engine cavity. The rotors are connected to an output shaft or driver. A combustible fuel mixture is provided to the engine cavity and ignited. An increase in pressure in the engine cavity due to ignition of the fuel-air mixture results in a driving force being applied to the rotors, thereby causing rotation of the driver.

There are also known rotary pumps and motors which have certain similarities to the above-described engine. An indication of the state of the art may be obtained by referring to the following patent publications:

U.S. Pat. No. 3,078,807, entitled Dual-Action Displacement Pump;

French Patent No. 9204757, publication No. 2,690,201;

U.S. Pat. No. 3,726,617, entitled Pump or a Motor Employing a Couple of Rotors in the Shape of Cylinders with an Approximately Cyclic Section; and U.S. Pat. No. 5,152,683, entitled Double Rotary Piston Positive Displacement Pump with Variable Offset Transmission Means.

The above patents generally do not provide structures which are conducive for use as internal combustion engines.

In the field of internal combustion engines, it is desirable to sustain high operating temperatures, thereby to maximize engine efficiency, in accordance with the well-known Carnot Law.

In the field of rotary internal combustion engines, there are known the following publications: U.S. Pat. No. 2,845,909, entitled Rotary Piston Engine, to Pitkanen; and U.S. Pat. No. 4,666,383, entitled Rotary Machine, to Mendler.

Pitkanen teaches a rotary piston engine having a pair of cam-shaped rotors which are arranged for parallel rotation inside an engine casing. Pitkanen is unable to work at high speeds due to the shape of the rotors, and, furthermore, seeks to cool the engine, thereby preventing an increase in temperature which, in Pitkanen's engine, is undesired. This results in an inefficient engine, based on the well-known Carnot Law, in which efficiency is proportional to the temperature difference between the interior and exterior of the engine, which Pitkanen does not sustain.

Mendler teaches a rotary piston engine having a pair of cam-shaped rotors which are arranged for parallel rotation inside an engine casing. Each rotor is described in the cited patent (column 8, lines 1–6) as having "major and minor cylindrical surfaces . . . , each centered on the axis A of the rotor, and diametrically opposed, . . . joined by cylindrical transition surfaces . . . " Furthermore, a plurality of seals are provided, thereby to provide rotor-to-rotor and rotor-to-bore-wall seals (column 7, lines 62–64). It will be appreciated that, due to the presence of seals, the engine taught by Mendler is not only unable to sustain high rotational speeds, due to friction losses, but also cannot operate at high temperatures, due to the necessary presence of lubricating oil in the engine cavity.

DEFINITION

The term "non-touching seal" is used to mean a non-physical barrier in a dynamic situation in which a working fluid is confined between a plurality of surfaces for a specified period of time, wherein at least one of the surfaces is in motion relative to the other and is spaced apart therefrom across a gap of predetermined dimensions, and wherein the dimensions of the gap and the relative velocity therebetween combine so as to prevent significant leakage of working fluid therepast, during the specified period of time. This is in contradistinction to dynamic seals which rely, solely or partially, on the presence of an additional sealing element to be in touching contact with a surface past which it is sought to prevent leakage of a working fluid.

SUMMARY OF THE INVENTION

The present invention seeks to provide a rotary machine which embodies yet further improvements in rotary machine operation, beyond those claimed and described in applicant's co-pending application U.S. Ser. No. 09/099,521 entitled Rotary Machine, the contents of which are incorporated herein, by reference.

In particular, the present invention seeks to provide a rotary machine which is characterized by a non-cylindrical rotor construction which facilitates the attainment of an elevated compression ratio, together with an attendant increase in fuel efficiency.

Additional advantages will become apparent from the following description.

There is thus provided, in accordance with a preferred embodiment of the invention, an improved rotary machine which includes:

- a housing having formed therein a generally elongate cavity, the cavity being formed by a pair of adjoining, partially overlapping cylindrical bores, each bore being separated from an adjoining bore by a pair of non-joining partition walls;
- a pair of non-cylindrical rotors arranged in the pair of adjoining bores, each rotor having a curved outer surface formed of a plurality of contiguous mutually tangential curved portions, wherein each rotor is disposed in one of the bores for synchronized, non-touching and same-directional rotation with the other of the pair of rotors;
- a pair of rotor shafts associated with each pair of rotors, each rotor shaft extending through one of the bores, and mounted transversely to each rotor so as to provide eccentric rotation thereof in the bore;
- a gear assembly and a driver associated with the rotor shafts, the assembly and the driver, cooperating to provide synchronized same directional rotation of the rotor shafts; and
- a plurality of gas ports formed in the housing and communicating with the elongate cavity thereof, for permitting selectable intake and exhaust of working gases, wherein, introduction of a working gas into interactive association with the rotors causes rotation of the pair of rotors and thus also of the driver.

Additionally in accordance with a preferred embodiment of the invention, each bore has a geometric center, and each rotor is mounted for rotation about a rotation axis spaced from the geometric center by a predetermined eccentricity;

each cavity is bounded by a pair of parallel wall surfaces transverse to the rotation axis;

the plurality of gas ports includes at least a pair of gas ports provided in communication with each bore, wherein a first of the gas ports is arranged at a first radius from the geometric center and a second of the gas ports is arranged at a second radius from the geometric center, wherein the second radius has a magnitude smaller than that of the first radius; and wherein each rotor is operative to rotate within one of the bores so as to periodically uncover the first port, thereby to enable a flow therethrough of a working gas.

Additionally, in accordance with a preferred embodiment of the invention, the pair of rotors are disposed in substantially equal angular orientation relative to the rotation axes thereof.

Additionally, in accordance with a preferred embodiment of the invention, each rotor has a pair of flat, parallel surfaces disposed in dynamic, non-touching, sealing relation with the pair of parallel wall surfaces of each cavity, and each rotor has formed therein a throughflow portion which is formed so as to be brought periodically into communicative association with the interior of the cavity and with the second gas port, so as to facilitate gas communication therebetween.

Additionally, in accordance with a preferred embodiment of the invention, each pair of rotors includes first and second rotors arranged for rotation within a predetermined pair of adjoining, respective, first and second bores such that the outer surfaces of the first and second rotors are always in dynamic, non-touching, sealing relation with each other.

Additionally, in accordance with a preferred embodiment of the invention, the machine is an internal combustion engine, and the rotors are operative, during the rotation thereof, to cooperate with the partition walls and predetermined portions of the side walls so as to periodically form combustion chambers therewith, and wherein the housing and the rotors are formed of a substantially non-heat conducting material, thereby to enable an elevated temperature to be sustained within the combustion chambers during operation of the engine.

Additionally, in accordance with a preferred embodiment of the invention, the elevated temperature, once attained during operation of the engine, is sufficient to cause combustion of an air-fuel mixture in the combustion chambers, even in the absence of an air compression ratio of greater than 1:19.

Additionally, in accordance with a preferred embodiment of the invention, the substantially non-heat conducting material is a ceramic material.

Additionally in accordance with a preferred embodiment of the invention, the first port is a working gas intake port, and the second port is a working gas exhaust port, and wherein each pair of rotors are operative to rotate through a working cycle having first and second portions, wherein, during the first portion of the working cycle, the first and second rotors are operative to rotate into first positions whereat they are initially spaced from a first side of the cavity so as to define a first working space therewith, and the first rotor is operative to uncover the working gas intake port in the first bore thereby to admit air into the space;

the first rotors and second rotors are operative to rotate into second positions so as to reduce the volume of the first working space and thus compress the working gas therein; and the first rotors and second rotors are operative to be rotated into third positions in response to an expansion of the working gas in the first working space, and such that the second rotor is operative to bring the throughflow portion thereof into communicative association with the interior of the cavity and with the exhaust port in the second bore, so as to facilitate exhausting of working gas from the second working space.

and wherein, during the second portion of the working cycle, the first and second rotors are operative to rotate into fourth positions whereat they are initially spaced from a second side of the cavity, opposite the first side of the cavity, so as to define a second working space therewith, and the second rotor is operative to uncover the working gas intake port in the second bore thereby to admit air into the second working space;

the first rotors and second rotors are operative to rotate into fifth positions so as to reduce the volume of the second working space and thus compress the working gas therein; and the first rotors and second rotors are operative to rotate into sixth positions so as to permit expansion of the working gas in the second working space, and such that the first rotor is operative to bring the throughflow portion thereof into communicative association with the interior of the cavity and with the exhaust port in the first bore, so as to facilitate exhausting of working gas from the second working space.

Additionally, in accordance with a preferred embodiment of the invention, during the first portion of the working cycle, as the first rotors and second rotors rotate into the third positions, the first rotor is operative to uncover the intake port in the first bore, thereby to permit a throughflow between the intake port in the first bore, the first working space, the throughflow portion of the second rotor, and the exhaust port in the second bore;

and wherein, during the second portion of the working cycle, as the first rotors and second rotors rotate into the sixth positions, the second rotor is operative to uncover the intake port in the second bore, thereby to permit a throughflow between the intake port in the second bore, the second working space, the throughflow portion of the first rotor, and the exhaust port in the first bore.

Additionally, in accordance with a preferred embodiment of the invention, the machine is an internal combustion engine, the first and second working spaces are first and second combustion chambers, the working gas intake ports are air intake ports, and the working gas exhaust ports are combustion gas exhaust ports, and wherein the machine also includes at least first and second fuel injectors for injecting fuel into the first and second combustion chambers so as to provide fuel-air mixtures therein and so also as to enable combustion of the fuel-air mixtures, thereby to provide a rotational force on the second rotor during the first portion of the working cycle, and on the first rotor during the second portion of the working cycle.

Additionally, in accordance with a preferred embodiment of the invention, the machine also includes ignition apparatus associated with the first and second combustion chambers, for selectably igniting the fuel-air mixtures therein.

Additionally, in accordance with a preferred embodiment of the invention, the machine is a motor, associable with an external source of pressurized working gas, wherein each bore has a geometric center, and each rotor is mounted for rotation about a rotation axis spaced from the geometric center by a predetermined eccentricity;

each cavity is bounded by a pair of parallel wall surfaces transverse to the rotation axis;

the plurality of gas ports includes at least a pair of gas ports provided in each bore, wherein a first of the gas ports is arranged at a first radius from the geometric center and a second of the gas ports is arranged at a second radius from the geometric center, wherein the second radius has a magnitude larger than that of the first radius; and wherein each rotor is operative to rotate within one of the bores so as to periodically uncover the second port, thereby to enable a flow therethrough of a working gas.

Additionally, in accordance with a preferred embodiment of the invention, each rotor has a pair of flat, parallel surfaces disposed in dynamic, non-touching, sealing relation with the pair of parallel wall surfaces of each cavity, and each rotor has formed therein a throughflow portion which is formed so as to be brought periodically into communicative association with the interior of the cavity and with the first gas port, so as to facilitate gas communication therebetween.

Additionally, in accordance with a preferred embodiment of the invention, each pair of rotors includes first and second rotors, each arranged for rotation within a predetermined pair of adjoining, respective, first and second bores such that the outer surfaces of the first and second rotors are always in dynamic, non-touching, sealing relation with each other.

Additionally, in accordance with a preferred embodiment of the invention, the first port is a pressurized working gas intake port, and the second port is a working gas exhaust port.

Additionally, in accordance with a preferred embodiment of the invention, the machine is a compressor, associable with an external source of working gas, wherein each bore has a geometric center, and each rotor is mounted for rotation about a rotation axis spaced from the geometric center by a predetermined eccentricity;

each cavity is bounded by a pair of parallel wall surfaces transverse to the rotation axis;

the plurality of gas ports includes at least a pair of gas ports provided in each bore, wherein a first of the gas ports is arranged at a first radius from the geometric center and a second of the gas ports is arranged at a second radius from the geometric center, wherein the second radius has a magnitude larger than that of the first radius; and wherein each rotor is operative to rotate within one of the bores so as to periodically uncover the second port, thereby to enable a flow therethrough of a working gas.

Additionally, in accordance with a preferred embodiment of the invention, each rotor has a pair of flat, parallel surfaces disposed in dynamic, non-touching, sealing relation with the pair of parallel wall surfaces of each cavity, and each rotor has formed therein a throughflow portion which is formed so as to be brought periodically into communicative association with the interior of the cavity and with the first gas port, so as to facilitate gas communication therebetween.

Additionally, in accordance with a preferred embodiment of the invention, each pair of rotors includes first and second rotors, each arranged for rotation within a predetermined pair of adjoining, respective, first and second bores such that the outer surfaces of the first and second rotors are always in dynamic, non-touching, sealing relation with each other.

Additionally, in accordance with a preferred embodiment of the invention, the second port is a working gas intake port, and the first port is a pressurized working gas exhaust port.

There is also provided, in accordance with an alternative preferred embodiment of the invention, for use with a rotary machine, a rotor which includes:

a pair of parallel side surfaces; and a curved outer surface formed between the pair of parallel side surfaces, formed of a plurality of contiguous mutually tangential curved portions.

Additionally, in accordance with a preferred embodiment of the invention, the curved outer surface includes:

a major portion defining a first major arc subtending a predetermined angle at a predetermined center of rotation, and having a first radius;

a minor portion defining a first minor arc subtending a predetermined angle at the predetermined center of rotation, and having a second radius, shorter than the first radius, the major and minor arcs being arranged along an axis of symmetry; and a pair of similar, intervening curved portions extending tangentially between major and minor arcs.

Additionally, in accordance with a preferred embodiment of the invention, each of the pair of intervening curves is formed of mutually tangential, a second major arc and a second minor arc, of predetermined radii.

BRIEF DESCRIPTION OF THE DRAWINGS

The present invention will be more fully understood and appreciated from the following detailed description, taken in conjunction with the drawings, in which:

FIGS. 6A, 6B and 7 are schematic illustrations of pairs of rotors as illustrated in FIGS. 4A–5, showing the geometrical construction thereof;

FIG. 10B is an elevation of a non-joining partition wall seen in

FIG. 10A, taken along line XI—XI therein;

FIGS. 12A–12C are schematic cross-sectional views of the machine of FIG. 1, taken along line X—X therein, and showing the different positions of the rotors during different stages of operation;

DETAILED DESCRIPTION OF THE INVENTION

Figure 1:
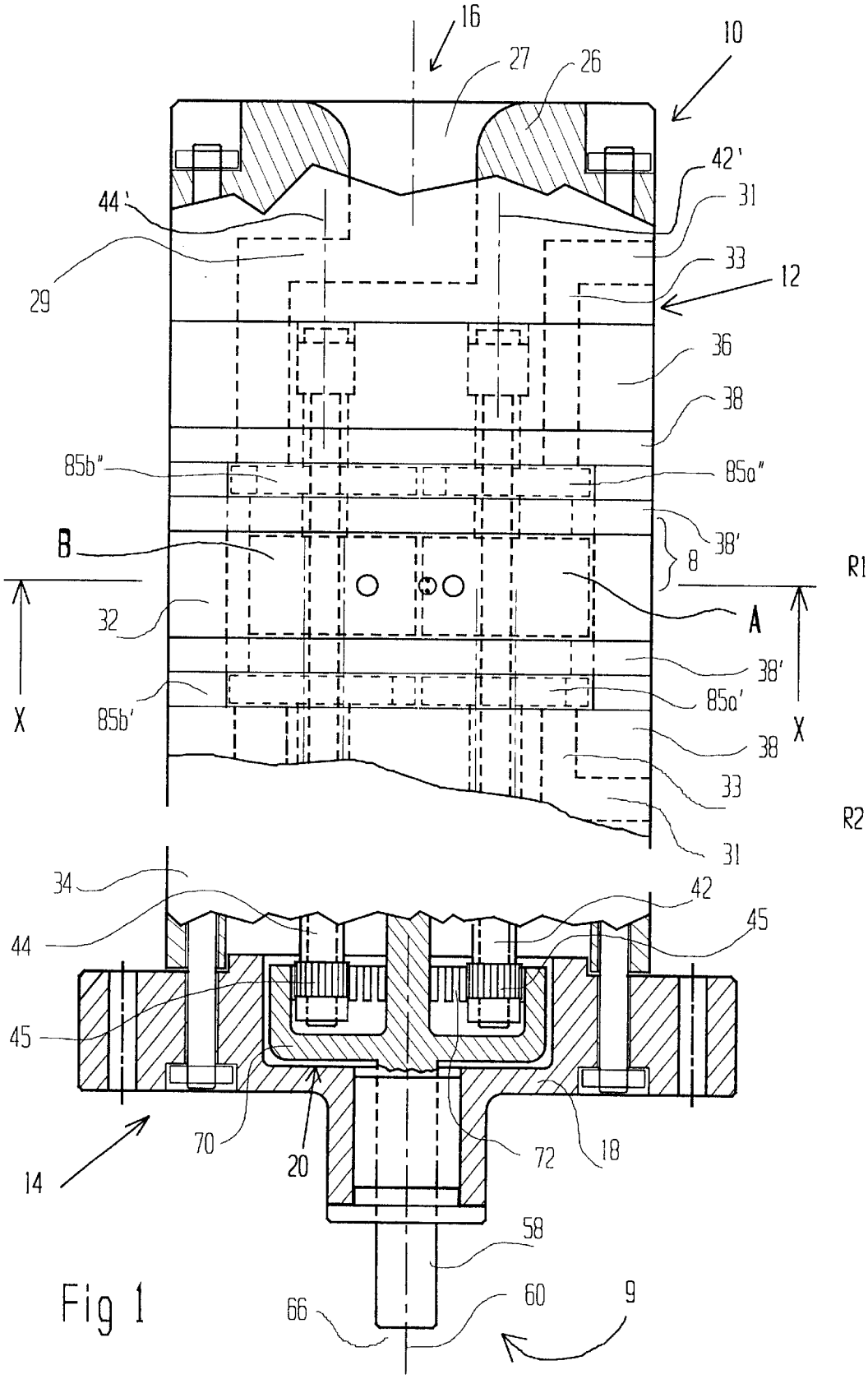
FIG. 1 is a partially cut-away, schematic side view of a rotary machine formed in accordance with a preferred embodiment of the present invention.

Referring now to FIG. 1, there is seen an improved rotary machine, referenced generally 10, constructed and operative in accordance with the present invention. In accordance with a preferred embodiment of the present invention, machine 10 is formed as an internal combustion engine (ICE), as shown and described in conjunction with FIGS. 10A–13, 18A–18C, and 22A–28B, although, as shown and described below in conjunction with FIGS. 14A–15, it may alternatively be formed as a motor, or as a compressor, as shown and described hereinbelow in conjunction with FIGS. 17A–17D and 21.

For the purpose of clarity, all portions and components of the machine which are described herein with regard to FIG. 1, and which are also provided in any of the embodiments shown and described in any of the remaining drawings, are designated with reference numerals which, while corresponding to reference numerals employed in FIG. 1, may have prefixes designated in accordance with a particular embodiment of the invention, and are not described again hereinbelow, except as may be necessary to understand that embodiment. Likewise, prime (') or double prime (") notations may be employed to indicate alternative embodiments.

Returning now to FIG. 1, machine 10 has a body 12, which is substantially sealed from the atmosphere, and which has a first end 14 and a second end 16. First end 14 has thereat a gear housing 18 for housing a gear assembly 20 (seen also in FIG. 2), whose function is to synchronize the motion of a plurality of rotors, referenced A and B in FIG. 1, as described below in conjunction with FIGS. 8–12C. Second end 16 of body 12 preferably includes a manifold and distributor unit 26.

Body 12 is subdivided, in the present examples, into two rotor units, referenced generally R1 and R2. As seen in FIG. 1, rotor units RI and R2 include first and second rotor housings and 32 (of which a single one only is depicted in FIG. 1), so as to be disposed between gear housing 18 and manifold and distributor unit 26, while being separated therefrom by respective bearing plates 34 and 36.

Referring now to FIGS. 1, 20A–20B, and 24A–27, as discussed herein, in some situations there may exist problems of relatively low gas pressure prior to compression and subsequent to combustion, namely, a lack of sufficient pressure to fully exhaust, and insufficient negative pressures in the working chambers of the engine so as to draw in a sufficient air supply. This problem is also well known in the context of other, non-rotary engines.

As compared to valves employed in valved piston engines, the shutter elements of the present invention, act merely as shutters at low pressures, rather than as high pressure valves. In the present invention, all high-pressure sealing is provided by the non-touching seals as described herein at length.

The purpose of the shutter elements discussed herein, is to prevent flow of working gases at low pressure, when this is detrimental to the operation of the engine.

Figure 20B:
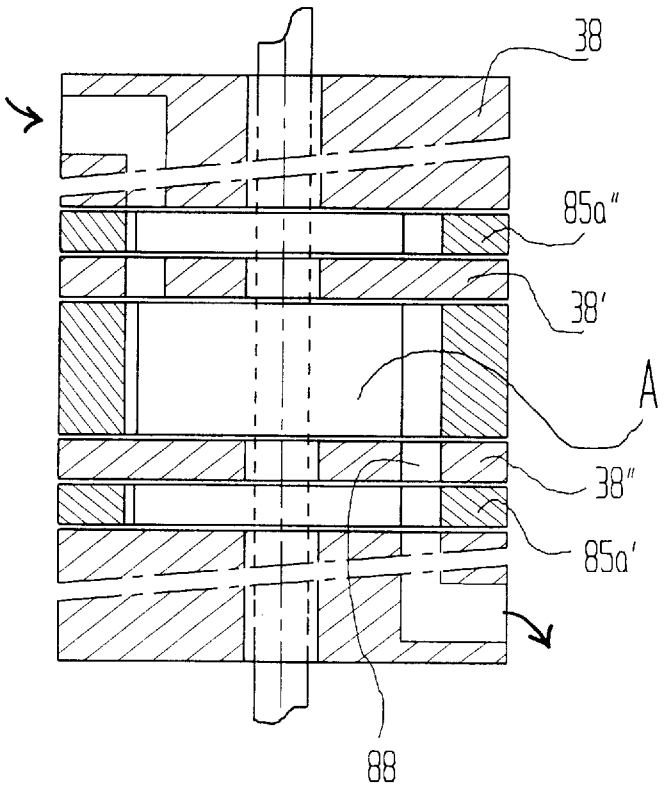
FIGS. 20A and 20B are schematic partially cut away side views of single rotor of FIG. 1, and associated flow control "shutter" elements, constructed in accordance with a preferred embodiment of the present invention.
Figure 20A:
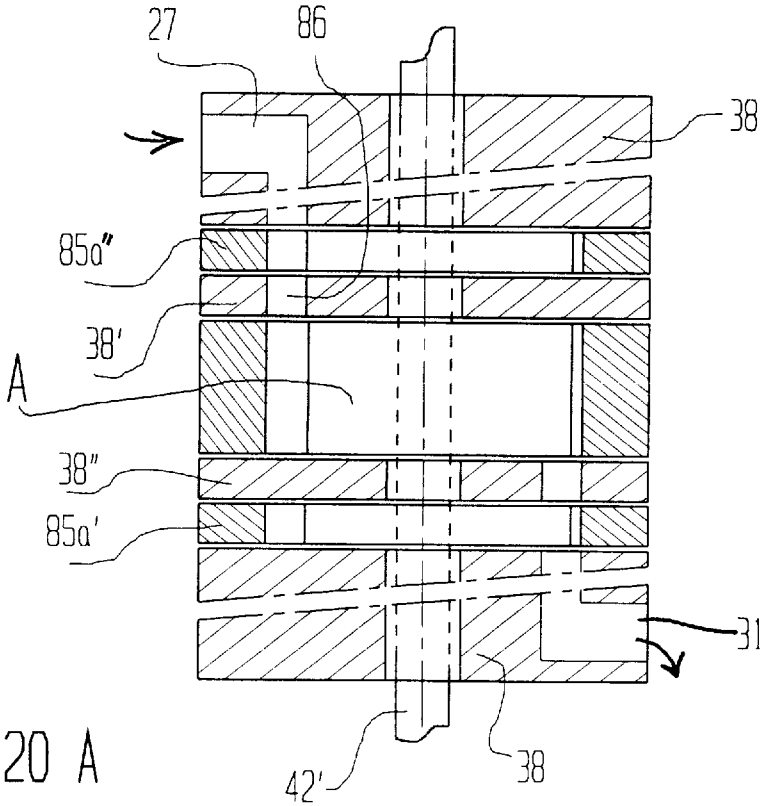

As seen in FIGS. 1, 20A and 20B, each rotor is bounded by a pair of inner partition walls, referenced 38'. In an upper partition wall 38', there is provided an air inlet port 86 (FIG. 20A), and in a lower partition wall 38 there is provided an exhaust port 88 (FIG. 20B). There are also provided outer partition walls, referenced 38, in which are provided openings which correspond to the inlet and exhaust ports, so as to facilitate air intake through air manifold 27, and exhausting of exhaust gases through outlet 31.

Located within each pair of inner and outer partition walls 38 and 38' is a shutter element, a lower shutter element being indicated by reference numeral 85*a*' and an upper shutter element being indicated by reference numeral 85*a*". As seen schematically in FIGS. 20A and 20B, the purpose of the shutter elements is to selectably close off the exhaust gases outlet, so as to maintain pressure within the working chamber, as seen in FIG. 20A, and to selectably close off the air intake into the working chamber, as seen in FIG. 20B, thereby to help maintain a sufficiently low pressure within the working chamber.

While not all the machines shown and described hereinbelow are specifically shown or described as having shutter elements 85, it is a particular feature of the present invention that, all such embodiments preferably employ the shutter elements, thereby to maintain proper working pressures during operation.

As seen in FIG. 1, each of rotor housings 32 defines first and second working cavities, which are separated from each other by a partition 38 which facilitates separation therebetween.

Manifold and distributor unit 26 has a working fluid intake 27 which is connected via a plurality of inlet conduits, depicted schematically at 29, for supplying a working fluid, typically atmospheric air, to the working cavities; and an exhaust fluid outlet 31, for exhausting exhaust gases from the working cavities via a plurality of exhaust conduits, depicted schematically at 33.

When machine 10 is constructed as an ICE, the exhaust gases are waste gases resulting from combustion of an air-fuel mixture. When machine is constructed as a motor or compressor, however, the exhausted fluid outlet 31 simply serves to permit egress of the working fluid from the machine.

Figure 8:
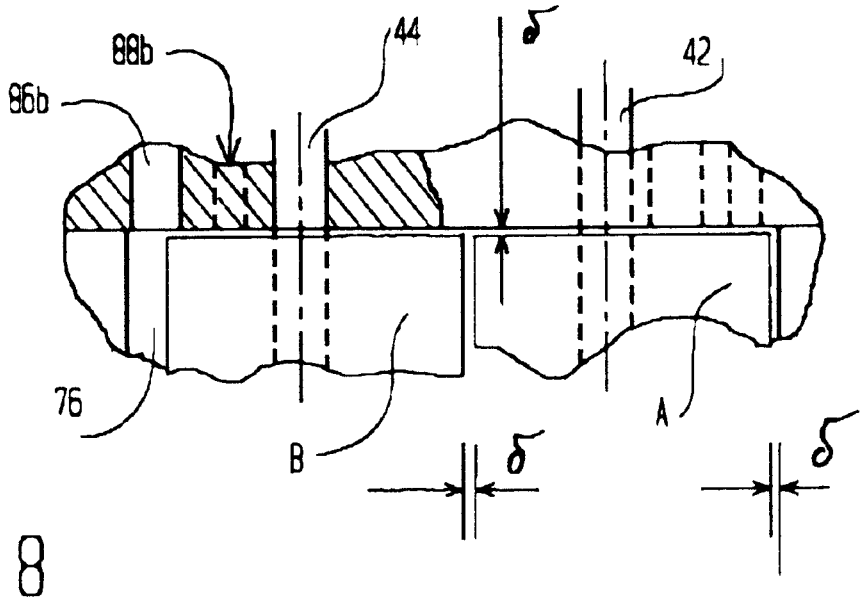
FIG. 8 is an enlarged view of a pair of rotors and side walls adjacent thereto, depicted as portion 8 in FIG. 1, and showing the non-touching dynamic seals therebetween employed in the present invention.
Figure 9:
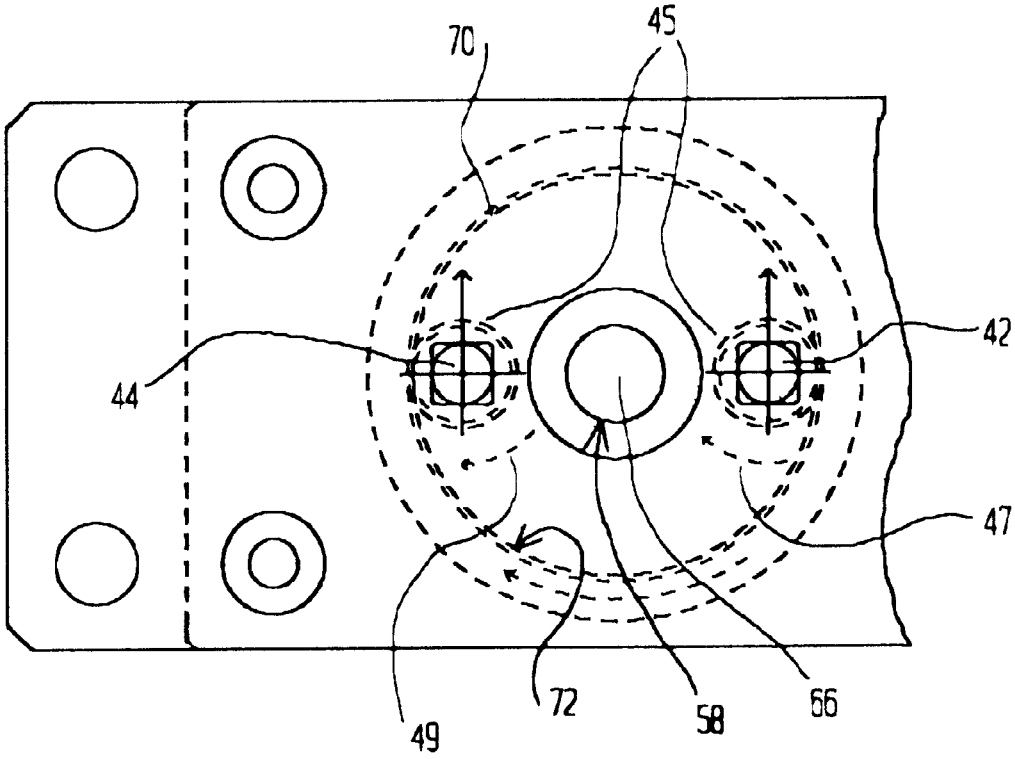
FIG. 9 is a schematic end view of the machine of FIG. 1, taken in the direction of arrow 9 therein.
Figure 10A:
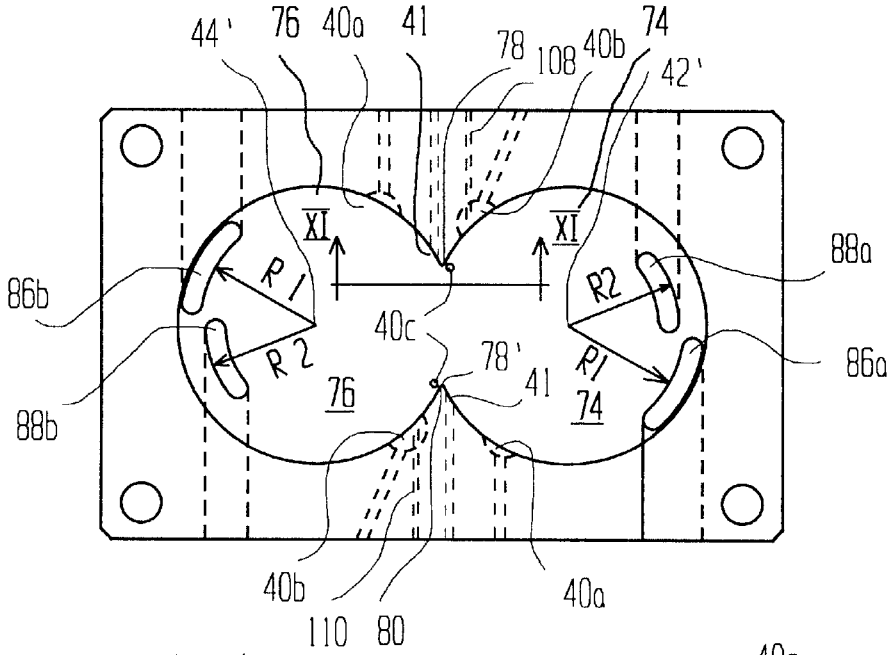
FIG. 10A is a cross-sectional view of the machine of FIG. 1 configured as an internal combustion engine (ICE), taken along line X—X therein, and showing a rotor housing thereof, but in the absence of the rotors.

Referring now also to FIGS. 2–5, and 8–12C, as relevant, each of rotor units RI and R2 (FIG. 1) includes first and second rotors, respectively referenced A and B, for rotation within a corresponding pair of bores, respectively referenced 74 and 76, FIGS. 10A, 12A and 12B) formed within each housing cavity 30*a* and 32*a*. As will be understood from the description below of FIGS. 12A–12C, the two rotors A and B must be mounted so as to have an identical angular disposition and, furthermore, their rotation is synchronized, so as to maintain this angular disposition.

For the sake of simplicity, the angular disposition of the rotors is indicated in FIGS. 12A–12C by arrowheads aa and bb, respectively. Progress of the rotors through their work cycles, described hereinbelow in detail, is indicated in FIGS. 12A, 12B and 12C by successive angular displacements of the arrowheads relative to the their previous positions. Rotors A and B are illustrated as being of similar dimensions, and bores 74 and 76 have equal diameters so as to accommodate rotation of the rotors.

As shown in FIG. 8, and as described hereinbelow, rotors A and B and bores 74 and 76 are dimensioned so as to provide "non-touching seals" between these components at the points of closest contact. These non-touching seals are not seals as understood in the art, which employ a physical gasket, fin or other element in touching contact with a surface with which it is sought to form a seal. Rather, the seal is essentially the minimum gap that may be employed between a pair of components, at least one of which is in motion, and wherein the velocity is such that the time period during which the seal is required is so short, that no significant leakage can occur. This is described hereinbelow in detail.

As seen in FIG. 1, the housing cavities, labeled 30*a* and 32*a* in FIGS. 12A and 12B only, when considered in a direction transverse to longitudinal machine axis 60, combine to from form a generally elongate cavity, and are formed, as seen in the drawings, by first and second cylindrical bores, respectively referenced 74 and 76 (FIGS. 10A and 12A–12B). As seen in FIGS. 10A and 12A, bores 74 and 76 are separated from each other by non-joining partition walls 78 and 80, illustrated in respective "upper" and "lower" positions.

The terms "upper" and "lower" are intended merely to orient the reader with regard to the disposition of the described portions as they are depicted in the present drawings, and not to define the orientation of the machine when operated.

Figure 2:
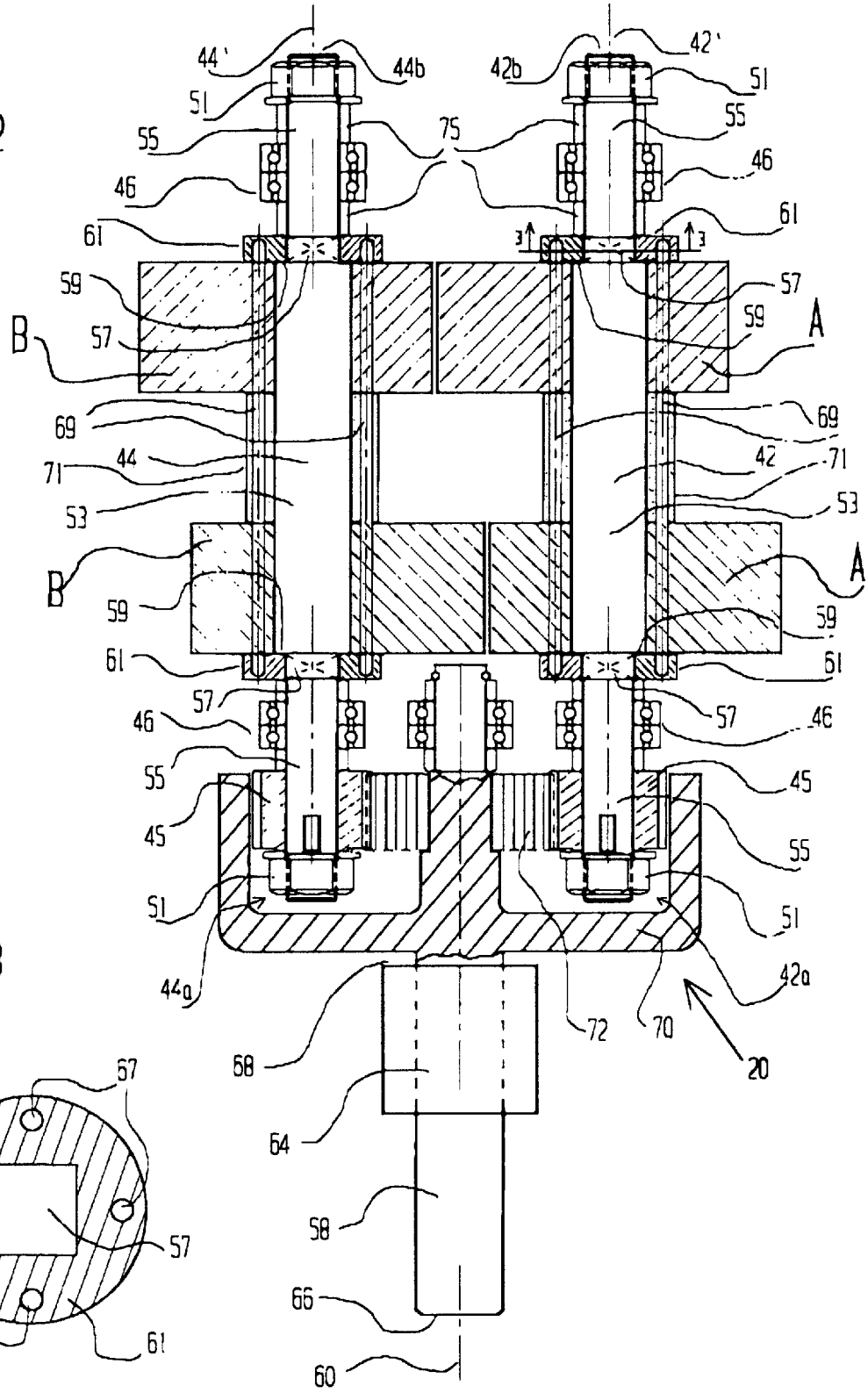
FIG. 2 is a schematic side view of the rotors, transmission and driver of the rotary machine of the invention, as depicted in FIG. 1, constructed in accordance with a preferred embodiment of the invention.

Referring now particularly to FIGS. 2, in order to facilitate the above mentioned synchronized motion, the rotors are mounted onto respective rotor shafts 42 and 44, which extend between respective first ends 42*a* and 44*a*, associated with gear assembly 20, and respective second ends 42*b* and 44*b*, which are supported via a first pair of bearings 46 in bearing plate 36 (FIG. 1), arranged between manifold and distributor unit 26 (FIG. 1) and housing 32 (FIG. 1). Rotor shafts 42 and 44 define longitudinal axes 42' and 44', (FIG. 2) which are parallel to longitudinal axis 60 of the machine 10. Respective first ends 42*a* and 44*a* of rotor shafts 42 and 44, have mounted thereon spur gears 45, which are arranged for rotation with rotor shafts 42 and 44, and the purpose of which will become apparent from the description hereinbelow.

There is also provided a second pair of bearings 46 which are mounted onto respective shafts 42 and 44 (FIG. 1), and which are located inside appropriately provided openings in partition 38 (FIG. 1). A main bushing, referenced 71, is mounted onto each of shafts 42 and 44, and functions as a spacer between the two rotors mounted thereon.

An output shaft or driver, referenced 58, extends typically along longitudinal axis 60 of the machine 10, and through an opening formed in a main bearing 64, which, in the illustrated arrangement, constitutes an outward extension of gear housing 18 (FIG. 1). A first, free end 66 (seen also in FIG. 9) of driver 58 may be coupled, as desired, to any external device, as known in the art. A second end 68, located within gear housing 18, has integrally formed therewith a rotary member 70, having formed thereon an inward-facing ring gear 72.

As seen in FIGS. 1, 2, and 9, spur gears 45 and inward-facing ring gear 72 are positioned so as to be in continuous meshing contact with each other. Accordingly, rotor shafts 42 and 44, and thus also spur gears 45 mounted thereon, rotate in the same directions, as indicated in FIG. 9 by arrows 47 and 49. Rotation of the spur gears 45 is synchronized so as to drive ring gear 72, rotary member 70, and thus also driver 58.

A further benefit of the above-described gear arrangement, is that it enables maintenance of an identical angular disposition of both of rotors A and B in each pair of rotors, as mentioned hereinabove.

It will further be appreciated that, in view of the fact that the respective diameters of spur gears 45 and ring gear 72 are predetermined at a ratio of, for example, 1:4–1:6, this causes a desired reduction in the rotational speed of driver 58.

The function of the bearings described above is to enable rotation of the shafts and gear assembly components with minimal friction, and so as to prevent any longitudinal or radial movement of the rotors and the shafts relative to the machine body, and appropriate bearings are selected in accordance with this requirement. The bushings are operative to provide exact and unvarying spacing of the rotors, bearings, and spur gears. As the gear assembly 20 and associated bearings must be lubricated, appropriate seals (not shown), well known to those skilled in the art, are provided, preventing lubricating fluid from either entering the interior of the rotor housings, or from leaking from any other portion of the machine body.

Figure 16:
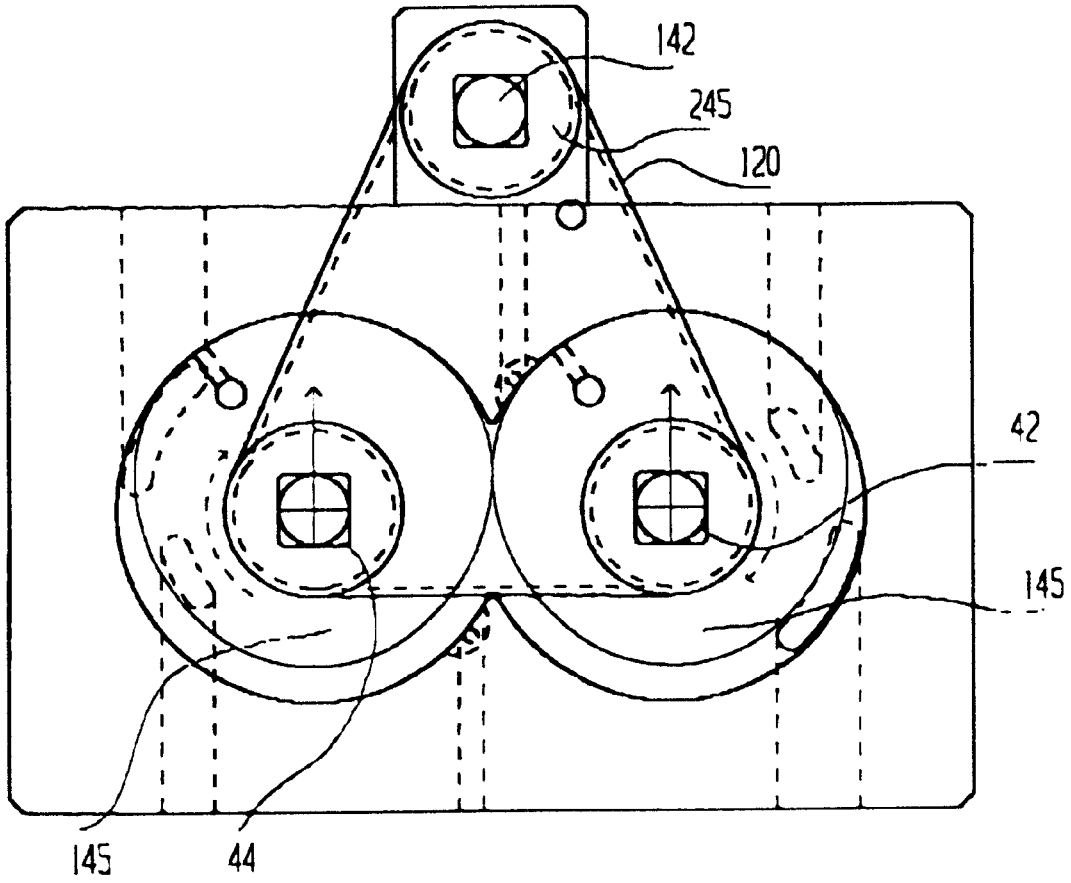
FIG. 16 is a cross-sectional view of the machine of FIG. 1, taken along the line X—X therein, and employing a belted synchronization mechanism, in accordance with a further embodiment of the invention.

Referring now briefly to FIG. 16, machine 10 may be modified such that, in place of transmission assembly 20 (FIGS. 1 and 2), there may be provided a toothed drive belt 120, which cooperates with suitable gears 145, thereby to provide the desired synchronization of rotor shafts 42 and 44 and rotors A and B, and so as to maintain the desired corresponding angular orientation thereof.

Preferably, in the present embodiment, the drive belt 120 extends also about a third gear member 245, external to the machine casing, which is drivably associated with a third shaft 142, typically parallel to shafts 42 and 44, and which functions as a power output member or driver. An example of a suitable drive belt is the single-sided synchronous polyurethane belt made by Gates GmbH of Eisenbahnweg 50, D-52068, Aachen, Germany.

An essential feature of the present rotary machine is the provision of exceedingly narrow gaps between the moving parts, namely, the rotors, and the body, and also between the rotors themselves, thereby constituting the "non-touching seals," seen in FIG. 8 and as described herein. Accordingly, essential requirements are accurate machining of the machine parts, as well as consistent position stability over time.

Accordingly, as seen in FIG. 2, the rotors and shaft in a single "rotor train" are tightly assembled, preferably by means of tightly fastened and secured by locking nuts 51 provided at each end of each of the shafts 42 and 44, and such that the sole touching contact with the rotor trains and any other portion of the machine 10 is via bearings 46, which are preferably both radial and axial, and spur gears 45.

Each of rotor shafts 42 and 44 is a steel shaft having a main portion 53, a pair of end portions 55, and a pair of locking portions 57, located between main portion 53 and end portions 55. Main portion 53 and end portions 55 are of circular cross-section, but main portion 53 has a relatively large diameter, while end portions 55 are of reduced diameter. Locking portions 57 meet main portion 53 so as to define square shoulder portions 59, and are formed so as to be non-circular, preferably square, so as to be lockably engageable with a locking disk 61, seen also in FIG. 3.

Main portion 53 is so dimensioned as to receive the rotors thereon. While the rotors are not directly connected to the shafts 42 and 44, the inner diameter of an opening 63 (FIGS. 4A and 4B) formed in each rotor, and the outer diameter of main shaft portion 53, are almost identical, such that virtually no relative lateral movement can occur therebetween. The two preferably square section locking portions 57 must be formed, as will be understood from the description below, so as to be in mutual angular alignment.

Figure 3:
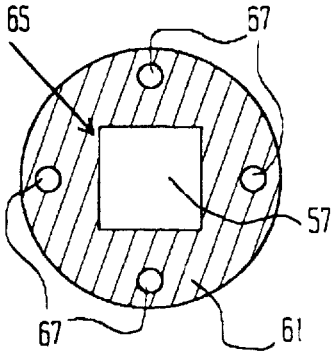
FIG. 3 is a cross-sectional view of a locking disk as seen in FIG. 2, taken along line 3—3 therein.

Referring now also to FIG. 3B, locking disks 61 are also made of steel, and have formed therein shaped openings 65, preferably square, dimensioned so as to fit precisely on the square locking portions 57. As seen, locking disks 61 have recesses 67 formed therein (referenced only in FIG. 3), spaced about central opening 65. Recesses 67 are blind, such that they do not extend through locking disks 61. While the distribution of the recesses may be varied, for reasons of dynamic balance, symmetry of this distribution must be maintained.

There are also provided elongate positioning pins 69, formed preferably of steel, which extend through precision formed openings formed along the length of main bushing 71, and terminate in blind recesses 67. Preferably, positioning pins 69 are dimensioned so as not to extend into the full depth of the recesses.

Figure 4A:
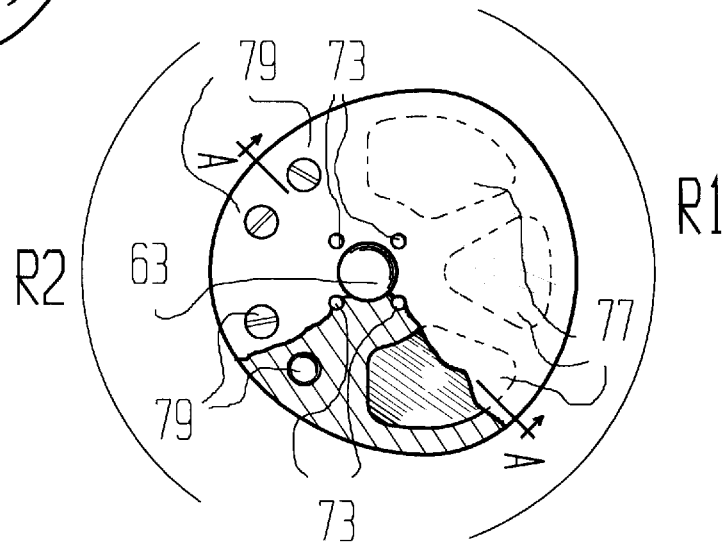
FIGS. 4A and 4B are a partially cut away plan view, and a cross-sectional view, respectively, of a rotor constructed in accordance with a preferred embodiment of the present invention.
Figure 4B:
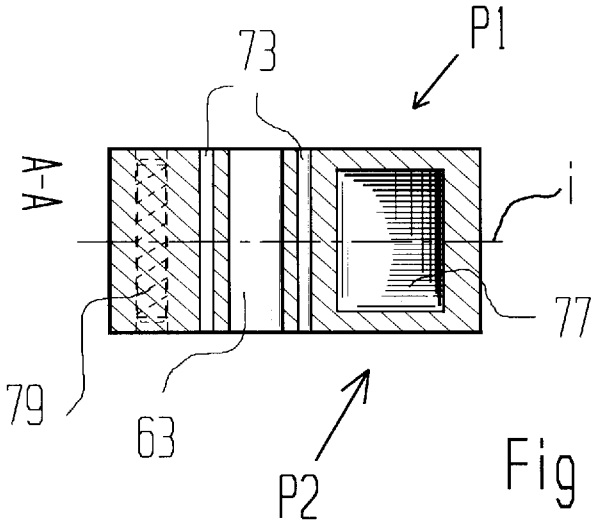

Reference is now also made to FIGS. 4A and 4B, in which is depicted a rotor constructed in accordance with a preferred embodiment of the present invention. In addition to opening 63, the rotor also has formed therein a plurality of narrow bores 73 which extend therethrough, and whose distribution about opening 63 is identical to that of the blind recesses 67 formed in locking disks 61. As described below in detail, rotors are preferably formed from ceramic materials, having a very low coefficient of thermal expansion, and high thermal insulation properties.

It is thus seen that each rotor train includes a shaft, main bushing 71, a pair of rotors, positioning pins 69 extending through openings formed through bushing 71 and the rotors, and that the rotors are positioned with respect to the shaft, by virtue of the engagement between the square openings 67 of locking disks 61, as disks 61 will only fit when properly oriented with respect to the ends of positioning pins 69. Once having been assembled, therefore, no relative rotation can occur among any of these components of each rotor train, such that a rotation of the rotors during operation of the machine, causes a corresponding motion of the shafts and thus also of the driver 58 (FIGS. 1–2).

In order to ensure that the positional integrity of each rotor train is maintained, locking nuts 51 are tightened appropriately, so as to axially compress, via bushings 71 and bearings 46 the above mentioned rotor train components. It will be appreciated that, while the interior portions of bearings 46 are locked together angularly, the exterior portions thereof are free to rotate thereabout.

In order to ensure that no less than a desired compression force is applied to the locking disks 61, rotors, and bushing 71, and minimal shear forces are applied to the positioning pins, it is preferable that the length of the main shaft portion 53, i.e. the distance between shoulder portions 59, is less than the combined length of the rotors, and bushing 71, such that no axial compression forces are applied to the shaft via its shoulder portions 59.

Referring now once again to FIGS. 4A and 4B, the rotor is formed so as to be dynamically balanced as it is rotated about a shaft axis. It is seen that the rotor is formed of a major portion, referenced generally R 1, and of a minor portion, referenced generally R2.

In order to prevent a dynamic imbalance from occurring as the rotor is rotated, mass is removed from the major portion R1, by way of providing hollow spaces therein, referenced 77; and mass is added by way of the addition of weights, referenced 79, to the minor portion R2. Clearly, the distribution and volume of the spaces 77, and the mass and distribution of the weights 79, will depend on the precise size and density of the rotor in any given application of the machine, and is thus not discussed herein in detail.

It will also be noted that typically the hollow spaces 77 are formed by manufacturing the rotor in two separate portions P1 and P2, which are then bonded together along a common interface i by use of a suitable cement, such as any of the BONCERAM™ series of ceramic adhesives, manufactured by Hottec Inc., of 1 Terminal Way, Norwich, Conn. 06360, USA.

As described hereinbelow, the rotors are preferably formed of ceramic materials which have a very low thermal expansion coefficient, and very high insulation properties.

Furthermore, while the weights 79 are preferably made of a suitable heavy metal, they are made from a material which is selected for its low thermal expansion coefficient. Furthermore, as will be appreciated from an understanding of the operation of the machine as an ICE, in the rotor portion R2 of the rotor the weights are located on the 'cool' side of the rotor, such that they are subjected to a minimum amount of heating. The positioning of the weights away from the exterior edge of the rotor, coupled with the good thermal insulation properties of the ceramic material from which the rotor is formed, further serves to reduce a chance of any damaging thermal expansion of the weights.

Figure 5:
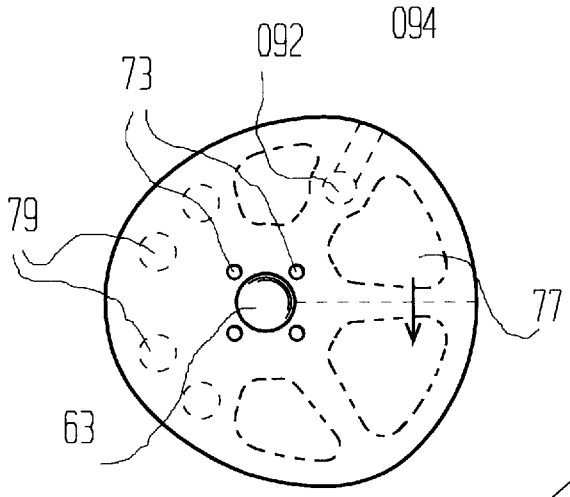
FIG. 5 is a plan view of a rotor constructed in accordance with an alternative embodiment of the present invention.

Referring now briefly to FIG. 5, there is shown a rotor which is generally similar to that shown and described in conjunction with FIGS. 4A and 4B, except that it also has formed therein a lateral bore 092 having an opening in a predetermined face of the rotor, and one or more radial bores 094 which are transverse to lateral bore and communicate therewith. Bores 092 and 094 are provided so as to facilitate the passage of working gases therethrough in accordance with various embodiments of the invention, and as shown and described, by way of example, in conjunction with FIGS. 12A–18, and 21.

As described above, the rotors of the present invention, while having a generally rounded shape, are not circular. It will be appreciated that, while the precise shape and dimensions may change from application to application, the construction of the rotors must be very precise, and must be shaped so as to correctly interact both with each other and with the cylindrical interior side walls of the working chamber, so as to provide a desired compression of working fluids, and momentary formation of combustion chambers, as they rotate at high speed.

In general, and as seen in FIGS. 6A–7, the rotor is formed of two segments having radii R and r of different sizes, and which are connected by identical curves in which each segment thereof is tangential to adjoining segments. Further as seen in the drawings, the identical rotors rotate about respective, parallel axes $P_A$ and $P_B$, in the same direction, and always in a corresponding angular alignment. Furthermore, from the rotor construction described below, it will be evident that the rotors are shaped such that the distance between their peripheries, regardless of the positions of the rotors, always remains constant.

The construction of the rotors is described below in conjunction with FIGS. 6A–7. It will however be understood, that the dimensions of the key moving and stationary components of the machine can be determined only after determination of the dimensions of the rotors. Once these dimensions have been determined, adjustments will be made thereto so as to account for the required gaps between the rotors and between the rotors and the sides of the working chamber. In practice, these adjustments will be $-\delta/2$ for each of the rotors, and $+\delta/2$ for the inner dimensions of the housing.

Referring now initially to FIG. 6A, the geometrical conditions for the above construction and interrelation between the rotors are:

The height of the rotor taken along an axis of symmetry bisecting the major and minor segments $S_1$ and $S_2$ equals D.

$D=R_1+R_2$, in which $R_1$ is the radius of the major segment $S_1$, and $R_2$ is the radius of the minor segment $S_2$.

Each of the arcs $A_1$ of segment $S_1$ and $A_2$ of segment $S_2$ subtends an angle $\alpha$ at axis P, such that the arcs define points J, K, L and M.

Point J, whose position varies in accordance with the magnitude of the angle $\alpha$, is used to determine the origins of radii r and R (FIG. 7), which are used to plot the points defining the curves which connect between the arcs of the major and minor segments.

It will now be seen that the shape of the rotor can be determined as follows:

extending a perpendicular bisector VV to the line $P_AP_B$, such that the distance to each of the axes $P_A$ and $P_B$ equals D/2.

As seen in FIG. 6B, the angle between $P_AP_B$ and $P_AJ$ is bisected so as to obtain the line $P_AC$.

A normal is extended from point J to $P_AC$, so as to intersect VV at point D'.

A line EE is extended through point D' parallel to $P_AP_B$.

As now seen in FIG. 7, each point of intersection between EE and JL, and between EE and KM, are used to define the origins $O_1$ and $O_2$. It is now evident that $O_1K=O_2J=r$, and $O_1M=O_2L=R$;

wherein r is the radius of segments Ke' and Je"; and

R is the radius of segments Le' and Me".

Advantages of the Rotor

The inventor has found that the rotor of the present invention, when employed in a rotary machine generally as described herein, provides for compression ratios of up to 1:18. This represents a further improvement over the cylindrical rotor of the applicant's co-pending application U.S. Ser. No. 09/099,521.

Furthermore, notwithstanding the fact that the present rotor is non-cylindrical, it is nonetheless built so as to observe the various rules set forth for the cylindrical rotor of U.S. Ser. No. 09/099,521, which rules include:

- an unchanging spacing or gap providing the herein-described non-touching seal
- in view of the fact that the shape of the rotor, while not being cylindrical, is generally round, it is able to rotate at high speeds, such as 20,000 rpm
- the property of balance has been retained, by employing various compensatory measures, as described in conjunction with FIGS. 4A–5.

General Description of the Machine as an Ice

Referring generally now to FIGS. 12A–12C, 18A–19, and 22A–27 as described above, a preferred embodiment of the machine of the present invention is as an ICE, of which the essential operation—including the cyclical compression of air and bringing it to predetermined combustion chambers C1 (FIG. 12B) and C2 (FIGS. 12A and 12C) within respective working chambers 30*a* and 32*a*; and the injection of fuel so as to cause an explosion within the combustion chambers, thereby to cause rotation of the rotors—is described in applicant's co-pending application U.S. Ser. No. 09/099,521 entitled Rotary Machine, the contents of which are incorporated herein, by reference.

More specifically, a selected liquid fuel, typically hydrocarbon, is supplied to combustion chambers C1 and C2 preferably by suitable fuel injectors, at one or more suitable locations in the working cavities. While various embodiments of the invention are shown and described hereinbelow in conjunction with FIGS. 12A–12C, 18A–19, and 22A–27, the fuel injection locations are determined, inter alia, in accordance with the type of fuel that it is intended to use, namely, a diesel type fuel or a gasoline type.

In the event that a gasoline type fuel is intended to be used, it is preferred to inject it at a relatively more upstream location, referenced 40*a*, substantially prior to compression.

Figure 10B:
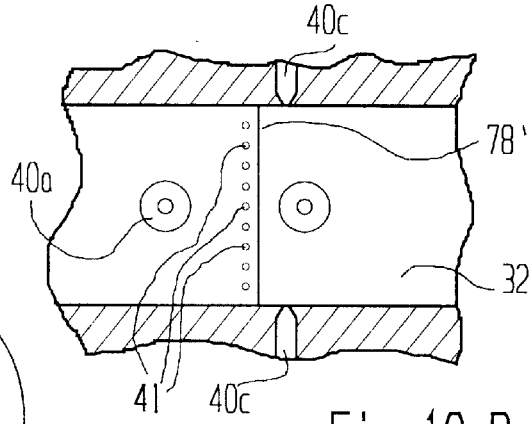

Referring now briefly to FIGS. 10A and 10B, in order to prevent the possibility of combustion occurring in the combustion chamber earlier than desired, due to a fuel-air mixture being brought into contact with a very hot surface portion of a leading rotor, a gas screen may be provided immediately upstream of the rotor, thereby delaying contact between the combustible mixture and the rotor. Typically, this screen may be provided by introducing into the combustion chamber streams of pressurized gas, preferably air, via nozzles 41.

In the event that a diesel type fuel is to be used, it is preferred to inject it at one or more relatively more downstream locations, referenced 40*b* and 40*c*, so that the fuel is injected into an air volume that is already compressed.

The fuel injector may be any suitable high speed electronic injector, or, for example, as manufactured by Orbital Engine Company (Australia) Pty. Limited, of Balcatta, Australia, and similar to that described in the article entitled CAN THE TWO-STROKE MAKE IT THIS TIME?, published on pages 74–76 of the February 1987 publication of POPULAR SCIENCE.

Repeated combustion at the same portions of the rotors and housing, in substantially insulated chambers, causes a significant increase in temperature during operation of the engine in the chambers, to temperatures well above the ignition temperatures of fuels used therein. Therefore, the engine components, including rotors A and B, housings 32, bearing plates 34 and 36 (FIG. 1), and partition plate 38 (FIG. 1), are built from materials that are capable of withstanding very high temperatures.

By way of example, the rotors and housing may be formed of ceramics such as direct sintered silicon carbide, of which the maximum use temperature is 1650° C., and reaction bonded silicon nitride, having a maximum use temperature of 1650° C.

However, the mere fact that the fuel air mixture ignites so as to provide heat, and the rotor associated therewith is seen to have worked, i.e. by rotation, this necessarily is accompanied by a decrease in temperature. Moreover, the supply of cool air with fuel, and similarly, the exit of exhaust gases from the engine, together with the accompanying entry of cool air into the engine, moderates the temperature increase to a point at which thermal equilibrium is reached. The point of thermal equilibrium is, however, higher than the combustion temperature of fuels used in conjunction with the engine of the invention.

By way of example, as known by persons skilled in the art, diesel fuel normally requires an air compression ratio of at least 1:19 in order to reach an ignition temperature. In the present invention however, even though the compression ratio may be well below 1:19, the elevated temperature of the surfaces after initial operation of the engine, is, as described above, sufficient to maintain ignition during successive combustion cycles, without requiring either sparking or increased air compression.

It is a feature of the present invention that, in order to enable operation of the machine, when used as an ICE, at high temperatures, and maximum power output of the machine, the following conditions are met:

- rotors A and B, housings 30 and 32, bearing plates 34 and 36 (FIG. 1), and partition plate 38 (FIG. 1), are made of a material having low thermal expansion and good thermal insulation properties,
- the rotors do not touch any of the stationary surfaces, or each other, and
- there are no parts in the rotor housings that require lubrication.

It will be appreciated that, construction of the machine in accordance with the above conditions, is facilitated by forming the rotor and rotor housings of a suitable ceramic material, which may be, by way of non-limiting example, silicon nitride or silicon carbide, as mentioned above. The rotors and housings must, of course, also be formed so as to have mechanical strength adequate for their intended use.

The use of a ceramic material is itself facilitated by the fact that none of the moving parts touch, as well as the fact that the bores are completely cylindrical, and rotors A and B are mounted therein so as to be parallel thereto, and normal to rotation axes 42' and 44'. As described above in conjunction with FIGS. 4A and 4B, each rotor is also centrifugally balanced; and each rotor together with its shaft, is also centrifugally balanced, bearing in mind that one or more additional rotors may be mounted on the same shaft, inter alia, as shown and described in conjunction with FIGS. 1–2, in a single rotor train. Furthermore, each portion of body 12, including gear housing 18, rotor housings 32, as well as the various sealing and bearing plates therebetween, is precision formed. The bores via which the shafts extend through the rotors are also perpendicular to the rotor surfaces contiguous therewith.

Furthermore, as described in detail above in conjunction with FIG. 2, the rotors and shafts are mounted together so as to be tight fitting, and so as to prevent any relative rotation therebetween.

It will be appreciated that the tolerances between the various machine portions can be reduced in accordance with the accuracy of their manufacture, and this, in turn, improves the performance of the machine.

The use of ceramics for construction of the rotors, rotor housings 32, bearing plates 34 and 36, and partition plate 38, enables high operating temperatures to be sustained, thereby providing a large temperature difference between the interior and exterior of the engine, so as to maximize its efficiency, in accordance with the well known Carnot Law. The absence of lubrication in the combustion chambers also leads to a reduction in emissions caused by burning of lubricating fluids.

It will be appreciated by persons skilled in the art that, as opposed to reciprocating engines in which the combustion cavities have a low ratio of surface area to volume, in the present invention, in which the combustion cavities have a high ratio of surface area to volume, if either the rotors or the rotor housings were to be made from a heat conductive material, such as metal, there would be a very large and rapid loss of thermal energy, and the present invention would not be able to function as an internal combustion engine.

It is an important feature of the invention that, in order to maximize machine performance, frictional loss is reduced to a minimum. Accordingly, while rotors A and B may appear to be touching in certain positions, and the rotors may also appear to be touching inner surfaces of the rotor housings, as seen in the magnified view of FIG. 8, rotors A and B are never in touching contact with any portion of the housings or each other. The clearance δ across the gaps between the rotors, and between the rotors and stationary surfaces is preferably in the range 0.03–0.08 millimeter. Accordingly, it is to be expected that, during operation of the machine, there is developed a high linear speed at the periphery of the rotors, providing insufficient time for any significant leakage to occur between either the rotors at their point of closest contact, or between the rotors and the stationary surfaces, such that these gaps function as non-touching seals, as described above. By way of example, when the width (R1+R2, as seen in FIGS. 6A–7) of the rotors is 160 millimeters, the rotational speed may be, by way of non-limiting example only, about 16,000 rpm, giving a linear speed of 134 m/s.

Each rotor A and B in each pair of rotors, is mounted, as seen clearly in FIGS. 1 and 2, for eccentric rotation about rotation axes 42' and 44'.

Referring now once again briefly to FIG. 10A, housing 32 is seen in elevational view, without rotors A and B. It will of course be appreciated that housings 32 are substantially the same, but that they are preferably oppositely positioned within machine 10, so as to enable a desired alternating intake of air at each side of the machine, and a corresponding alternating exhausting of exhaust gases, therefrom. This alternate positioning provides a corresponding alternating power cycle, which provides for a balanced operation of the machine.

As seen in FIG. 10A, bores 74 and 76 have respective side walls, in which are formed air inlet ports 86*a* and 86*b*, and exhaust ports 88*a* and 88*b*. Inlet ports 86*a* and 86*b* are situated at an exterior portion of bores 74 and 76, so as to be periodically uncovered during the power cycle of the machine, as described below, due to the eccentric rotation of rotors A and B within bores 74 and 76. Exhaust ports 88*a* and 88*b* are positioned so as to be covered at all times by rotors A and B, flushing of exhaust gases therethrough being enabled periodically during rotation of rotors A and B, via exhaust conduits formed within the rotors, as shown and described below in conjunction with FIGS. 12A–13. The positions of respective inlet ports 86*a* and 86*b* relative to respective axes 42' and 44' are indicated by radii denoted RI, while the positions of respective exhaust ports 88, which are situated more inwardly thereof, are indicated by radii denoted R2.

Shutter elements 85 (FIGS. 1, 24A–27) are provided, as described in detail above, in conjunction with FIGS. 24A–27, so as to maintain pressure, and is thus neither shown nor described again in conjunction with the present embodiment.

High pressures are developed within housings 32 during a working fluid "filling stage" due to the large volume of air required to be taken in, during a very short period of time. Accordingly, the air intake is preferably assisted by means of an external pressure source, such as a turbo mechanism or the like.

Figure 13:
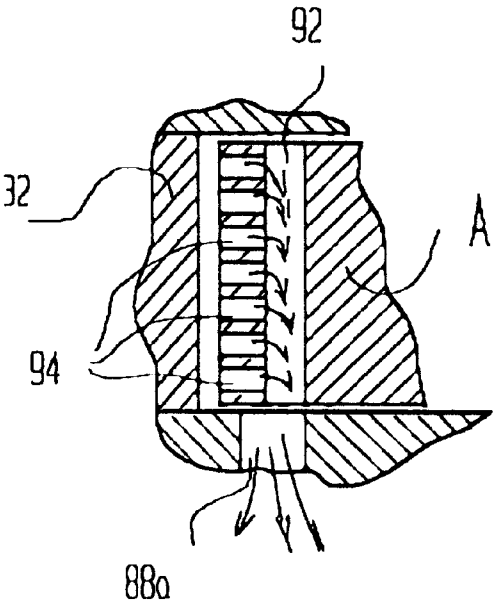
FIG. 13 is an enlarged schematic cross-sectional view of an exhaust portion of a rotor, during collection therein of exhaust gases, as seen in FIG. 12C, and taken along line 13—13 therein.

Referring now briefly to FIG. 13, in the present embodiment, each rotor is provided with an exhaust bore 92 formed transversely to one of the parallel, planar surface of the rotor, and a plurality of generally radially-aligned exhaust inlet bores 94 are connected thereto. During rotation of the rotors, bore 92 is periodically brought into registration with exhaust ports 88*a* and 88*b*, thereby permitting flushing of exhaust gases from the interior of the machine, as described below in more detail, in conjunction with FIG. 12B.

Figure 11A:
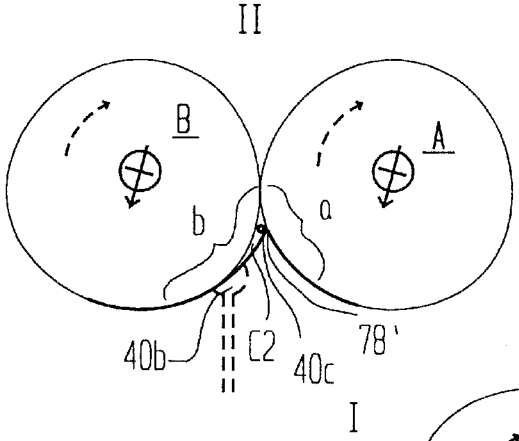
FIGS. 11A and 11B are schematic views of operational stages of a combustion chamber during a working cycle of the machine of the present invention, when employed as an internal combustion engine.

Referring briefly to FIGS. 11A–12C, the rotors and cavities of machine 10, when constructed as an ICE, are formed so as to provide for combustion to occur alternately in a first combustion chamber C1 (FIG. 12B), and then in a second combustion chamber C2 (FIG. 1A). First combustion chamber C1 is seen in FIG. 12B to be formed momentarily between the rotors and an upper side II of the rotor housing. Second combustion chamber C2 is seen in FIG. 11A to be formed momentarily between the rotors and a lower side I of the rotor housing.

It will be appreciated that the terms "upper" and "lower" merely correspond to the orientation of apparatus in the drawings, and have no significance therebeyond.

There are also provided upper and lower electrode pairs, respectively referenced 108 and 110, seen in FIGS. 12A–12C. Upper electrode pair 108 is required for ignition of the fuel-air mixture in upper combustion chamber C1 (FIG. 12B), and lower electrode pair 110 is required for ignition of a fuel-air mixture in lower combustion chamber C2 (FIG. 11A). Preferably, operation of the electrode pairs is required only during initial stages of operation of the engine, after which ignition occurs due to the elevated temperature at those surface portions of the machine cavity and of the rotors which are repeatedly exposed to combustion. Alternatively, however, the electrode pairs may be operated throughout operation of the engine, if required.

Prior to the description below of a complete working cycle of the machine 10 as an ICE, operation thereof with regard to a combustion force generated is described in conjunction with FIGS. 11A and 11B.

Shown in FIG. 11A is a combustion chamber C2, immediately after termination of compression of a volume of air therein and, in the case of use of a diesel-type liquid fuel, at the moment of injection of the fuel into the combustion chamber. The fuel is injected from either or both of fuel inlet locations 40*b* and 40*c*. Immediately following injection, there occurs ignition of the resulting fuel-air mixture confined in the combustion chamber.

In the case of use of a gasoline-type liquid fuel, injection occurs closer to the start of compression, via more upstream location 40*a* (FIG. 10A), and is thus not seen in the present drawing.

At this time, expansion of the combustion gases resulting from the ignition has just started, and the combustion chamber is bounded by portions of non-joining wall 78', as well as a relatively short portion a of rotor A, and a relatively long portion b of rotor B. For the duration of combustion in combustion chamber C2, rotor B is defined as the leading rotor, while rotor A is defined as the trailing rotor. As long as expansion of the combustion gases continues, there is a net rotational force applied to leading rotor B, causing rotation in a direction illustrated in FIG. 11A as clockwise, thus also causing an equal rotation of trailing rotor A, via gear assembly 20 (FIGS. 1–2).

Figure 11B:
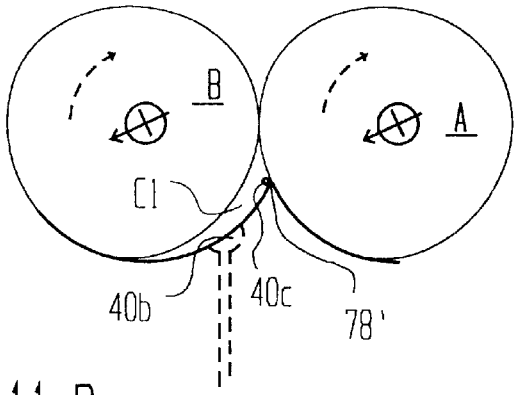

As rotors A and B continue to rotate, the combustion gases expand and combustion chamber C2 also increases in size accordingly, as seen in FIG. 11B.

This continues substantially until leading rotor B passes the position seen in FIG. 12A and, correspondingly, trailing rotor A passes beyond the illustrated position of dynamic non-touching sealing contact with the apex of partition 78, shown also in FIG. 1B, thereby to admit air into the chamber and to permit flushing thereof. Until this point is reached, and for the duration of the expansion of the combustion gases, leading rotor B undergoes a clockwise rotation.

The above example relates to the portion of the power cycle in which rotor B is the leading rotor and rotor A is the trailing rotor. In the portion of the power cycle in which combustion chamber Cl is employed, however, rotor A is the leading rotor, and rotor B is the trailing rotor.

Description of the Power Cycle of Machine 10 as an Ice

For sake of clarity, the following operating positions are described below in conjunction with FIGS. 12A–13, relating to a first side which appears as lower side I in the drawings, and to a second side which appears as upper side II in the drawings:

| FIG. # | Lower Side I | Upper Side II |
|---|---|---|
| 12A | End of expansion - just prior to commencement of exhaustion of gases via rotor B. Subsequent stages: Air intake & flushing of waste gases via rotor B | End of air intake Subsequent stages: Start of compression and fuel injection (GASOLINE-TYPE) |
| 12B | After end of exhaustion, continued air intake | Maximum compression in combustion chamber C1, fuel injection (DIESEL-TYPE), and combustion |
| 12C | End of air intake Subsequent stages: Start of compression in combustion chamber C2, fuel injection (GASOLINE-TYPE), and combustion | End of expansion - commencement of exhaust of gases via rotor A Subsequent stages: Air intake and flushing of waste gases via rotor A |

It will be appreciated that, where used, the terms "upper", "lower", "raised", and "lowered" are orientations used only to indicate portions or positions as they appear in the drawings, and that these portions or positions do not necessarily take on these orientations in the machine when in use.

Referring now initially to FIG. 12B, it is seen that rotors A and B are depicted in generally "raised" positions, so as to be in dynamic non-touching sealing contact with upper side surfaces 100 and 102 of respective bores 74 and 76. In these positions, rotors A and B are spaced apart maximally from respective lower side surfaces 104 and 106 of bores 74 and 76, whereat rotor A uncovers lower intake port 86*a*, while rotor B almost completely covers upper intake port 86*b*. In these positions, rotors A and B, together with upper non-joining partition wall 78, define an enclosed space in which is compressed a volume of air, and which, as shown, becomes combustion chamber C1.

In the event that a gasoline-type liquid fuel is being used, the volume of air will in fact be a volume of a compressed air-fuel mixture, due to an injection of fuel via fuel injection location 40*a*.

At this stage, air is supplied to the working chamber via lower intake port 86*a*.

In the event that a diesel-type fuel is used, it is supplied to combustion chamber C1, via either or both upper fuel injectors 40*b* or 40*c*.

The fuel-air mixture in combustion chamber C1 is ignited, in the present embodiment, by operation of upper electrode pair 108, causing a rotation of rotors A and B in a clockwise direction, towards the position seen in FIG. 12C, and as described above in detail in conjunction with FIGS. 11A and 11B.

At this stage, upper air intake port 86*b* becomes uncovered by trailing rotor B, thereby to permit an intake of air which is used not only for the flushing of exhaust gases from the working chamber, but also as the air component in lower combustion chamber C2 (FIG. 11B), during the next power cycle.

Referring now also to FIG. 13, combustion gases under high pressure enter into exhaust bore 92 of rotor A via the smaller diameter exhaust inlet bores 94, and they are exhausted through exhaust port 88*a*, once bore 92 is brought into registration therewith.

Referring now to FIG. 12C, rotor A is seen to have rotated to a position whereat it completely covers lower air inlet port 86*a*, and wherein exhaust bore 92 is in registration with upper exhaust outlet 88*a*, as seen in FIG. 13. In the event that a gasoline-type liquid fuel is being used, it is now injected via lower fuel injection location 40*a*, so as to mix with the air being compressed adjacent thereto.

Rotor B, having rotated through an angular displacement identical to that of rotor A so as to have uncovered upper air inlet port 86*b*, starts to move away from the apex of upper partition 78. Once this has happened, a "scavenging" gas flow path is provided so as to extend from upper air inlet port 86*b*, along the upper side surfaces 102 and 100 of respective bores 76 and 74, exhaust inlet bores 94, bore 92, and upper exhaust outlet port 88*a*. The provision of this flow path causes the hot waste gases to be flushed out of the cavity, and these may then be released into the atmosphere as via exhaust outlet port 31 (FIG. 1). Alternatively, however, due to the residual heat energy and pressure of the waste gases, they may be usefully recycled.

Subsequently, in the event that a diesel-type fuel is used, it is supplied to lower combustion chamber C2 (FIG. 11A), via either or both lower fuel injectors 40*b* or 40*c*.

The fuel-air mixture in the combustion chamber C2 is ignited by operation of lower electrode pair 110, causing a rotation of rotors A and B in a clockwise direction, towards the position seen in FIGS. 11B and 12A, and as described above in conjunction therewith.

At this stage, as seen in FIGS. 12A and 12B, lower air intake port 86*a* becomes uncovered by trailing rotor A, thereby to permit an intake of air which is used both for the flushing or scavenging of exhaust gases, seen in FIG. 12B, and as the air component in lower combustion chamber C2, during the next power cycle.

Figure 18A:
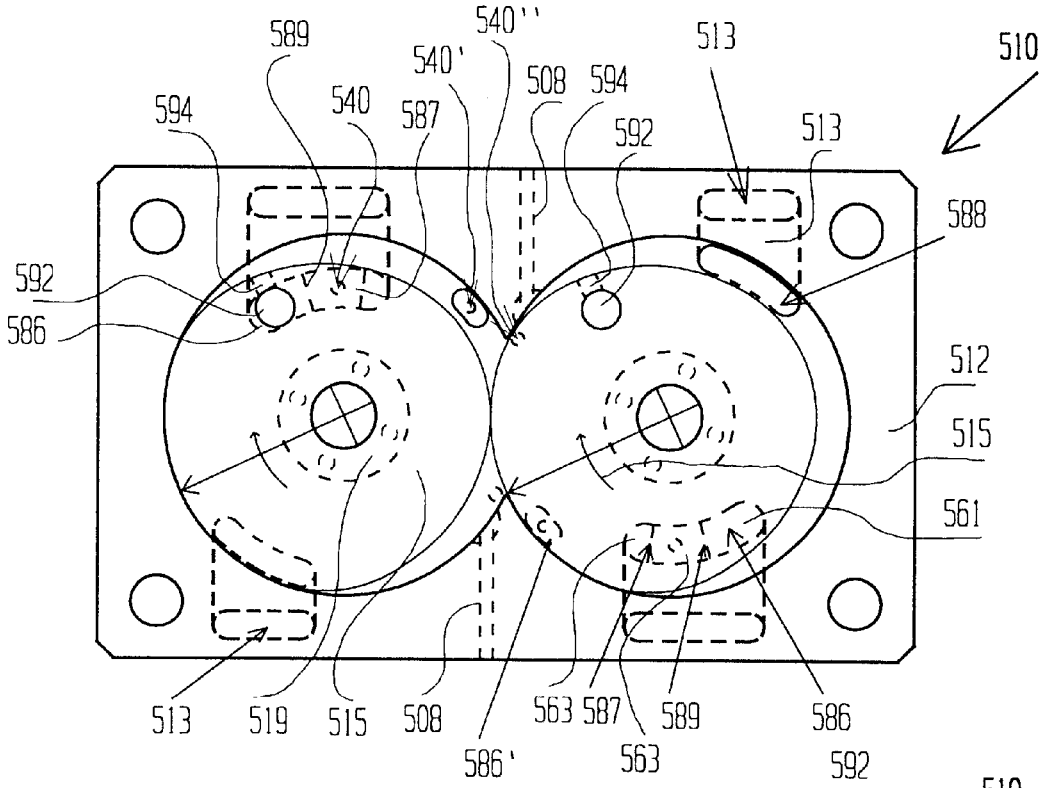
FIGS. 18A–18C are schematic cross-sectional views of the machine of FIG. 1, configured as an ICE, and constructed in accordance with an alternative embodiment of the present invention, shown in different operative positions.
Figure 18B:
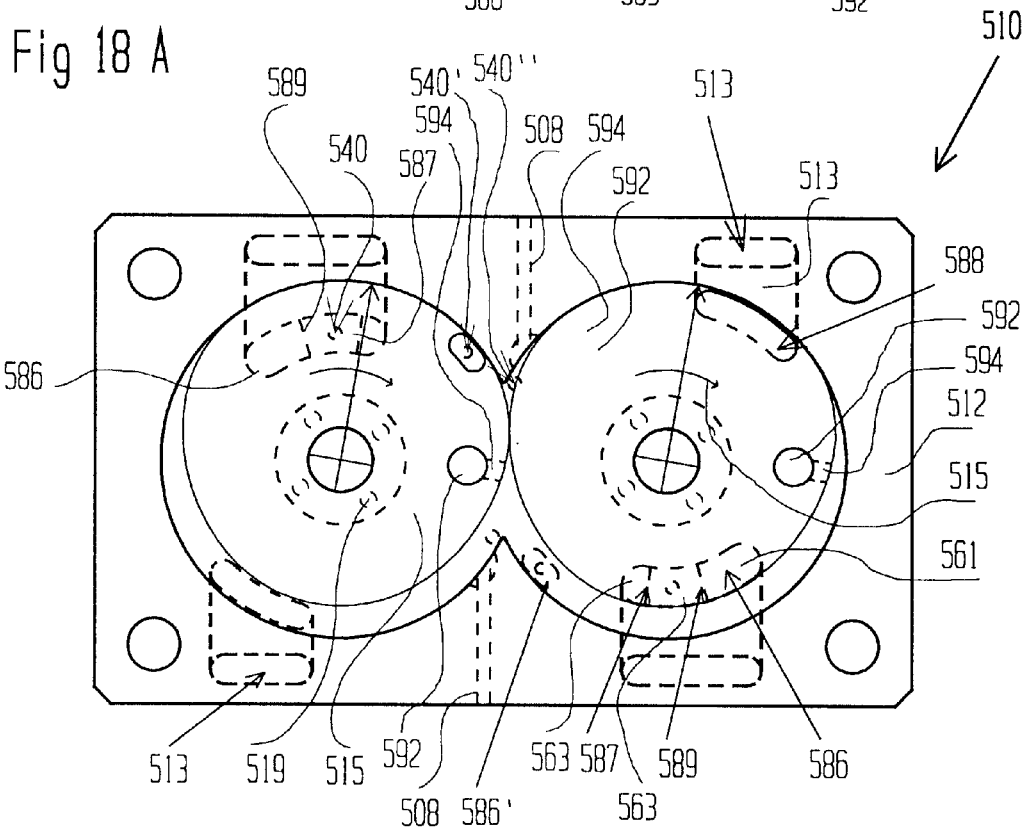
Figure 18C:
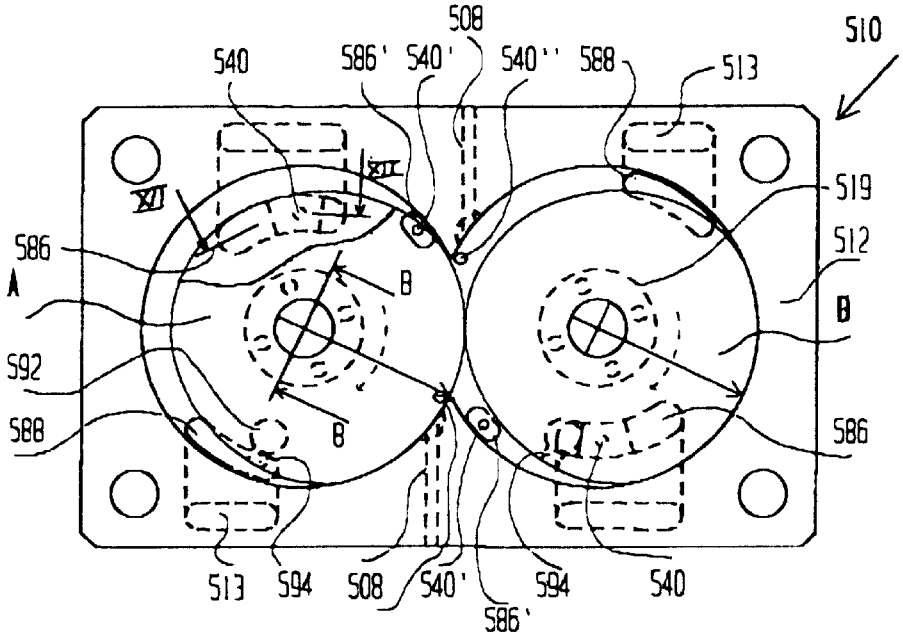

Referring now to FIGS. 18A–18C, there is seen, in three different operative positions, an internal combustion engine (ICE), referenced generally 510, constructed in accordance with an alternative embodiment of the invention. Several aspects of the present invention have been modified in ICE 510 relative to the ICE shown and described above in conjunction with FIGS. 12A–12C, and the present embodiment is thus described primarily with regard to those changes. Similarly, components of ICE 510 having counterpart components in FIGS. 12A–12C, are not specifically described again herein, and are denoted, where applicable by similar reference numerals with the addition of a prefix "5."

It will be noted that the positioning of the external air intake port 586 and exhaust port 588 are such that the main bores 592 and inlet bores 594 of the rotors serve for air intake into the working chambers, and exhaust gases are exhausted directly from the combustion chambers to the exhaust ports 588, thereby more readily exhausting exhaust gases than is provided with the configuration shown and described above in conjunction with FIGS. 12A–12C.

It is particularly noteworthy that, in addition to the air intake ports 586, there may be provided optional compressed air intake ports 586'.

Figure 19:
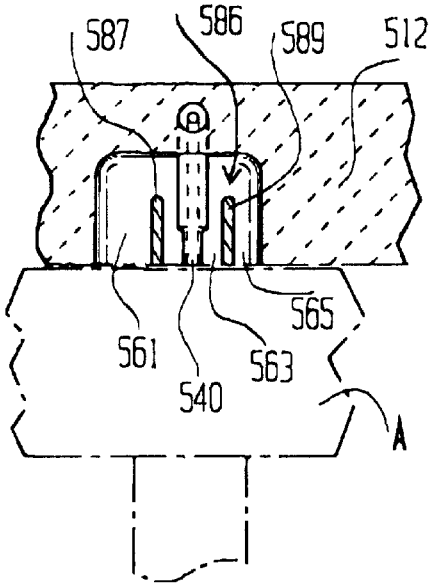
FIG. 19 is a cross-sectional view of a fuel injection portion of the engine seen in FIG. 18*c*, taken along line XII—XII therein.

Referring now also to FIG. 19, it is seen that air intake port 586, which is seen in FIG. 18A to be closed, and in FIG. 18C to be open to inlet bore 594 of rotor A, has located therein a pair of dividing walls 587 and 589. These walls 587 and 589 divide the mouth of port 586 into first, second and third compartments, 561, 563 and 565. In accordance with the present embodiment of the invention, middle compartment 563 has disposed therein a fuel injector 540, which may be in addition to, or in place of, a further fuel injector 540' disposed in additional compressed air intake port 586', and fuel injector 540".

As the rotors rotate in the direction indicated by arrows 515, compressed air from an external source (not shown) starts to enter the working chamber via air intake port 586 and inlet bores 594, as main bore 592 moves into registration with first compartment 561. The air thus entering the working chamber is clean air, and thus serves to scavenge or flush the working chamber of all burnt gases, prior to the start of compression therein. Subsequently, as main bore 592 is brought into registration with the second, middle compartment 563, fuel injector 540 is operated so as to inject fuel into the external air intake, thereby causing mixing of the fuel as it enters the working chamber, prior to compression and ignition, as by spark electrodes 508.

Immediately after the injection of fuel as described, and before the working chamber is sealed for the onset of compression, the rotor is further rotated such that main bore 592 is brought into registration with the third compartment 565, so as to permit a further intake of air. It will be appreciated that this flushes through any remaining fuel in the main bore 592 and inlet bores 594, and thus ensures that no fuel remains outside of the combustion chamber in formation as the rotors rotate.

Description of Machine 10 as a Motor

Figure 15:
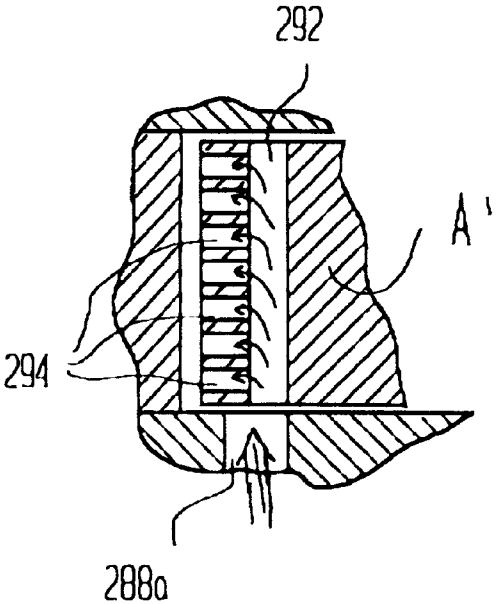
FIG. 15 is an enlarged schematic cross-sectional view of an intake portion of the rotor of FIGS. 14A–14E, during supply thereto of a pressurized working gas, as seen in FIG. 14C, and taken along line 15—15 therein.
Figure 14A:
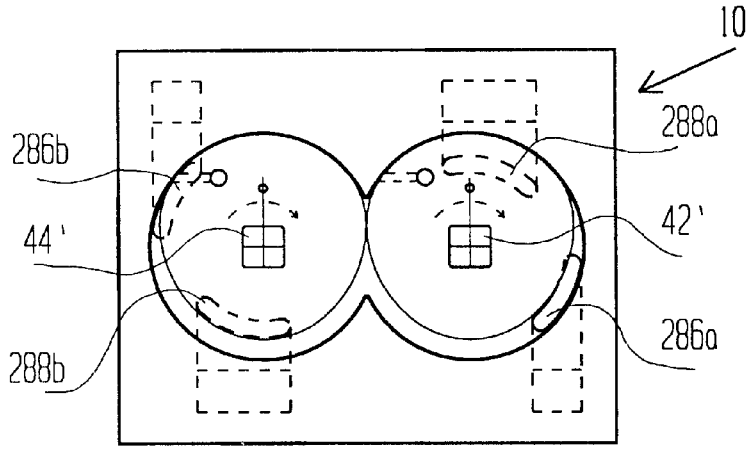
FIGS. 14A–14E are schematic cross-sectional views of the machine of FIG. 1, taken along line X—X therein, and showing the different positions of the rotors during different stages of operation, and wherein the machine of the invention is constructed as a motor, in accordance with an alternative embodiment of the invention.

Referring now to FIGS. 14A–15, machine 10 may, as described above, alternatively be used as a motor. In this case, machine 10 would be driven by an external source of a pressurized working gas.

In order to employ the external working gas in this way, the operation of machine 10 is reversed, such that the ports used as exhaust ports 88*a* and 88*b* in the embodiment of FIGS. 1–13 become working gas intake ports 288*a* and 288*b* in the present embodiment; and intake ports 86*a* and 86*b* of the embodiment of FIGS. 1–13, become exhaust ports 286*a* and 286*b* in the present embodiment. Similarly, as seen in FIG. 15, the pressurized working gas is provided via main bores 292 of the rotors, and is supplied onto the working cavity via inlet bores 294. In order to provide a desired operation, intake ports 288*a* and 288*b* are formed at a first radius from respective axes 42' and 44' so as always to be covered by the rotors A and B, and exhaust ports 286*a* and 286*b* are formed at a second radius from respective axes 42' and 44'—of greater magnitude than the first radius—so as to be periodically covered and uncovered during rotation of rotors A and B.

Figure 14B:
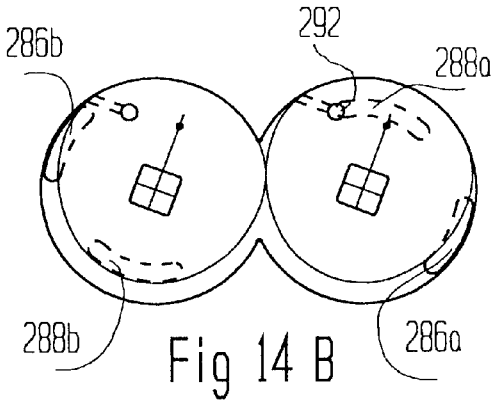
Figure 14C:
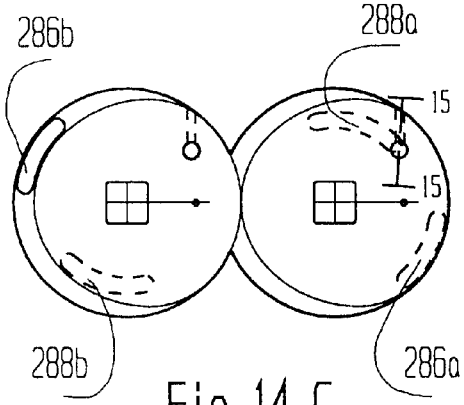
Figure 14D:
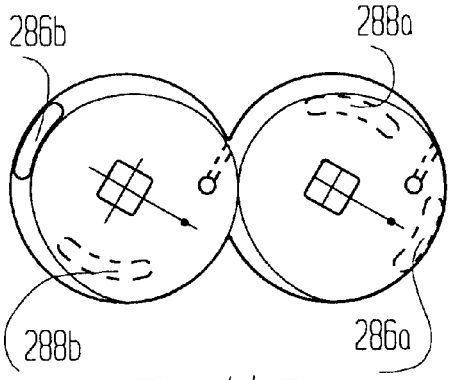
Figure 14E:
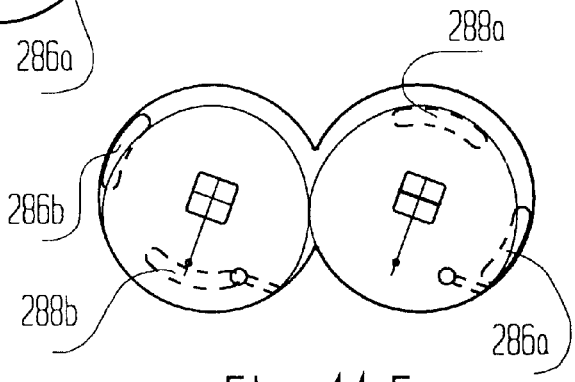

In operation, as the high pressure working gas is supplied to intake ports 288*a* and 288*b*, as, for example, in the position illustrated in FIG. 14B, in which collection bore 292 of leading rotor A is brought into registration with intake port 288*a*, the rotor is rotated by virtue of the pressure applied, and a rotational force is thus produced for the entire period that the collection bore 292 remains in registration with intake port 288*a*. The remainder of the power cycle for this embodiment of the invention is clearly illustrated in the remainder of the sequence of FIGS. 14A–14E, and is thus not described herein, in detail.

Description of Machine 10 as a Compressor

Referring now to FIGS. 17A–17D, machine 10 may, as described above, alternatively be used as a compressor. It will be appreciated that the operating cycle of the compressor generally follows that shown and described above in conjunction with FIGS. 12A–12C, in which machine 10 is an ICE. In the present embodiment however, exhaust ports 88*a* and 88*b* are seen to be shorter than those illustrated in FIGS. 10A and 12A–12C, indicating that the compressed air is expelled over a brief, predetermined period, thereby to provide a required burst of compressed air at a desired pressure and timing.

In accordance with one embodiment of the invention, the compressor may be incorporated into a machine system, generally as described in applicant's co-pending U.S. Ser. No. 09/099,521. Alternatively, however, the compressor may be used as a stand alone machine, and is thus provided with appropriate exit valving (not shown) so as to enable accumulation of a gas under pressure, as known in the art.

Figure 17A:
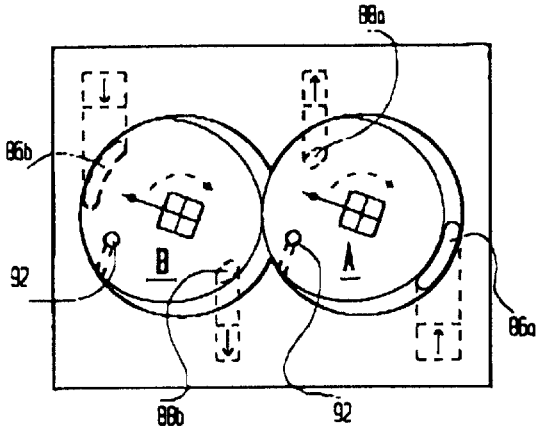
FIGS. 17A–17D are schematic cross-sectional views of the machine of FIG. 1, taken along line X—X therein, and showing the different positions of the rotors during different stages of operation, and wherein the machine of the invention is constructed as a compressor, in accordance with an alternative embodiment of the invention.
Figure 17B:
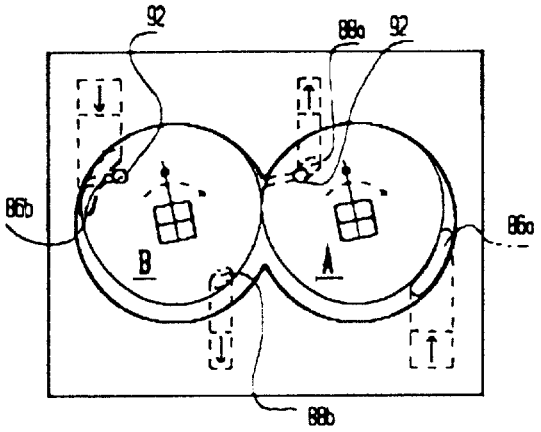
Figure 17C:
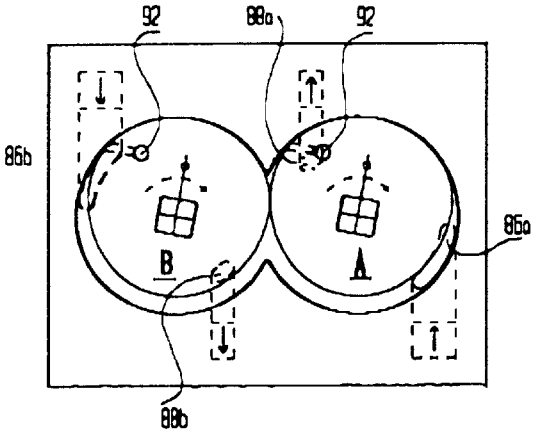
Figure 17D:
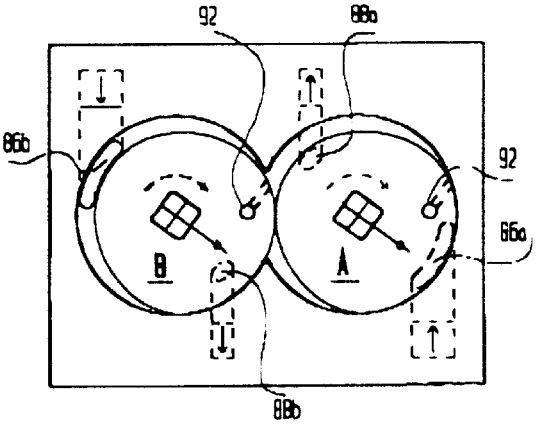

In brief, the power cycle for this embodiment of the invention is shown in the sequence of FIGS. 17A–17D, and is outlined in the following table:

| Drawing | Lower Side I | Upper Side II |
|---|---|---|
| FIG. 17A | Air intake | Start compression |
| FIG. 17B | Continued air intake | Compression near maximum, start output of compressed air burst |
| FIG. 17C | Continued air intake | End of compression, finish output of compressed air burst |
| FIG. 17D | Start compression | Air intake |

Figure 21:
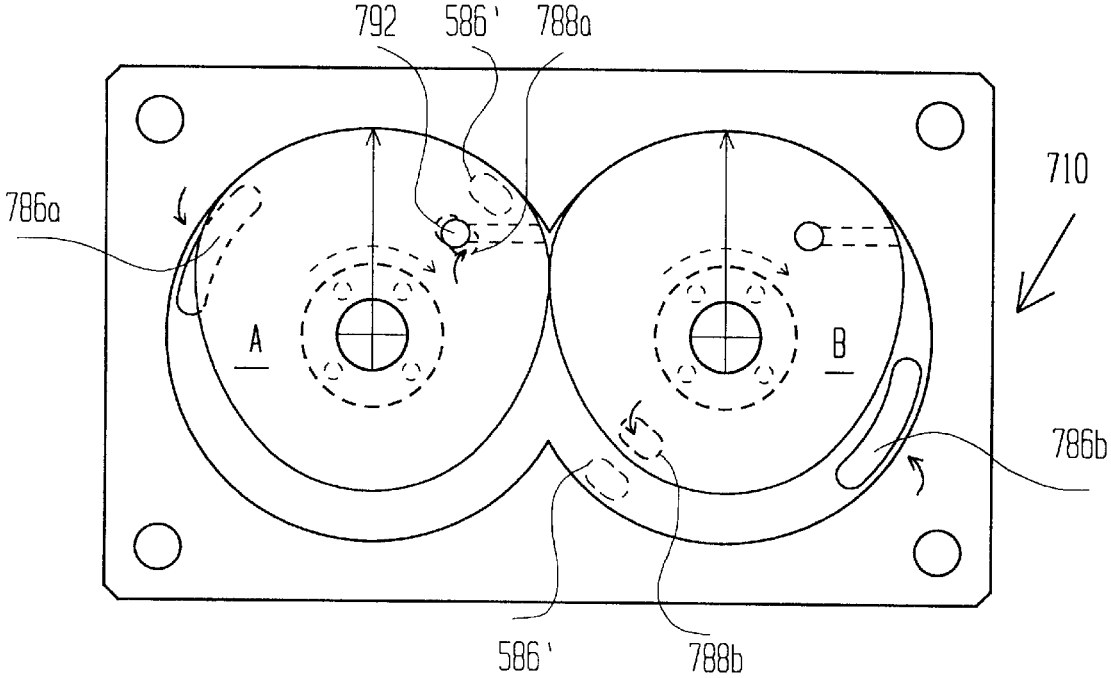
FIG. 21 is a cross-sectional view of the machine of FIG. 1, taken along line X—X therein, and wherein the machine is configured as a compressor in accordance with a further alternative embodiment of the present invention.

Referring now to FIG. 21, there is seen a compressor, referenced 710, constructed in accordance with an alternative embodiment of the invention. As may be seen, the only difference between the compressor of the present embodiment and the compressor shown and described above in conjunction with FIGS. 17A–17D, is that, a pair of intake and outlet ports 786*a* and 788*a* is disposed on the same side II for rotor A, and that the remaining pair of ports, 786*b* and 788*b* is disposed on the opposing side I, for rotor B. Also seen, in hidden detail, are the air intake ports 586' of engine 510, shown and described above in conjunction with FIGS. 18A and 18B, with which outlet ports 788*a* and 788*b* communicate so as to facilitate provision of compressed air from the compressor 710 directly to the working chamber of ICE 510, when used in a machine system therewith.

It will be noted that components of compressor 710 having counterpart components in FIGS. 17A–17D, are not specifically described again herein, and are denoted, where applicable by similar reference numerals with the addition of a prefix "7."

Use of Machine 10 as a Diesel Engine

Referring now generally to FIGS. 22A–23B, there is shown a diesel engine, referenced generally 410, constructed in accordance with an alternative embodiment of the invention. Several aspects of the present invention have been modified in ICE 410 relative to the engines shown and described above in conjunction with FIGS. 12A–12C, and the present embodiment is thus described primarily with regard to those changes. Similarly, components of engine 410 having counterpart components in FIGS. 12A–12C, are not specifically described again herein, and are denoted, where applicable, by similar reference numerals, but with the prefix "4."

By way of introduction, diesel engines, per se, are well known, as is the fact that the air that is used to create the "fuel-air" mixture needed to operate a diesel engine is compressed in the engine in the absence of fuel. This contrasts with gasoline engines, wherein the air is compressed together with the fuel.

The reason for the pre-compression of the air prior to the introduction of fuel, in the case of the diesel engine, is that this enables a much greater compression of the air, which greatly increases the temperature of the compressed air. Subsequently, the injection of fuel into the space containing the hot compressed air, leads to ignition of the fuel upon contact with the air, thereby to produce the gases so as to drive the engine.

The rotary machine of the present invention lends itself to use as a diesel engine, primarily due to the high compression ration that is achieved, as described herein. Furthermore, as known, in a piston engine, compression of the air, injection of the fuel, and ignition of the fuel-air mixture are all performed at the same location, namely, in each cylinder, so as to drive the related position.

In the rotary engine of the present invention, however, the portions of the engine in which air is compressed, are located differently from those portions where fuel is injected and combustion occur. It will also be borne in mind that, as described above, the rotary mechanism of the present invention is constructed of ceramic materials having special isolative properties which, inter alia, prevent the transfer of heat from one place to another within the engine. This creates a relatively cold spot in part of the air collection and compression space. Use of this feature will be discussed below.

As seen in the drawings, engine 410 has identical upper and lower sides, referenced generally I and II, which operate alternately. Engine 410 is seen to have rotors A and B which rotate about respective axes 442' and 444', in a manner similar to that described herein. As with other embodiments of the invention, rotors A and B rotate in a clockwise direction, although if desired, the engine could be modified so as to allow for counter-clockwise rotation of the rotors.

Engine 410 has formed therein a pair of working fluid inlet ports 486*a* and 486*b*, via which air may enter into working chambers 474 and 476, respectively. Each of inlet ports 486*a* and 486*b* has associated therewith means, such as the herein-described shutter elements 85 (FIG. 1, 20A and 20B), such that air may be allowed to enter through the inlet ports, but may not exit therethrough. When the rotors are in the positions shown in FIG. 22A, rotor B blocks off air inlet port 486*b*, and rotor A seals against upper non-joining partition wall 478 so as to prevent escape therepast of air from compression chamber 476.

Figure 22A:
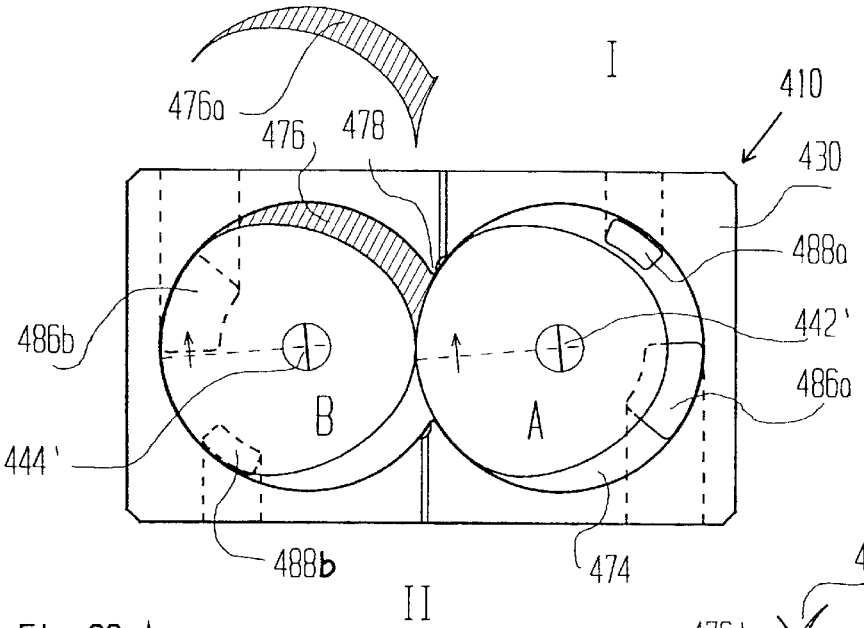
FIGS. 22A–22D are schematic cross-sectional views of the machine of FIG. 1, taken along line X—X therein, and showing the different positions of the rotors during different stages of operation, and wherein the machine of the invention is constructed as a diesel engine, in accordance with a further embodiment of the invention.
Figure 22B:
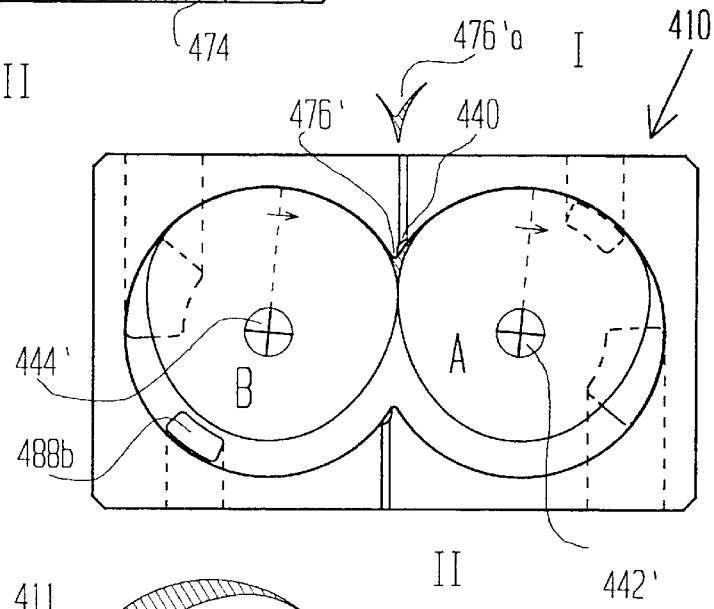

As the rotors continue to rotate, as shown in FIG. 22B, compression chamber 476 reduces in size, such that the air therein becomes compressed into a much smaller space, indicated as 476'. The relationship between the respective volumes of chamber 476 before compression and chamber 476' after compression, may be seen with reference to those areas shown in FIGS. 22A and 22B, respectively, indicated separately as 476*a* and 476'*a*.

The ratio between these volumes is more than 18:1, representing at least an 18 fold compression of the air within the compression chamber. This causes a significant increase in the temperature of the air within the space 476'.

At the position seen in FIG. 22B, when the air is compressed to a maximum fuel is injected into the heated, compressed air via a fuel injection location 440. Due to the contact of the injected fuel particles with the hot air, combustion occurs.

Figure 22C:
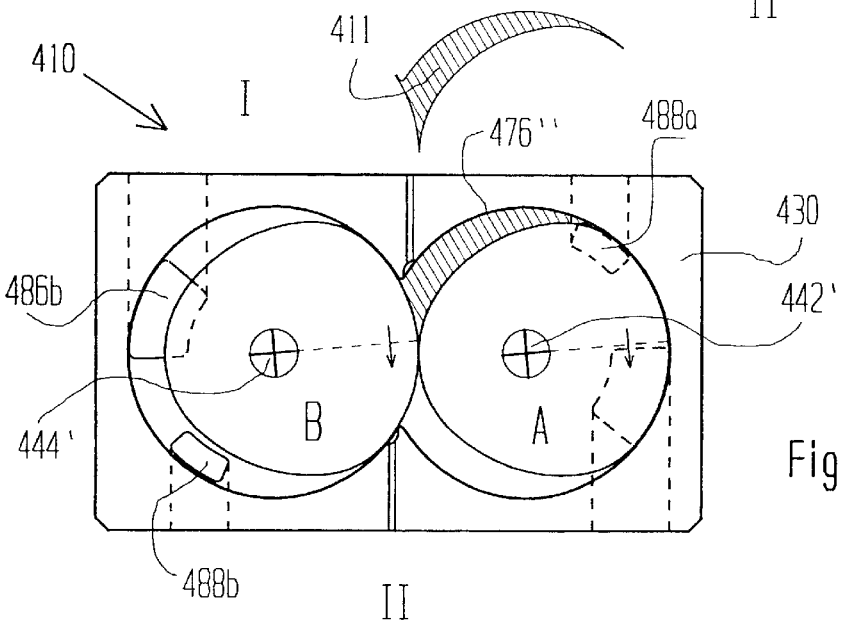

Further rotation of the rotors allows expansion of the exhaust gases as seen in FIG. 22C, and thereafter exit via exhaust port 488*a*.

As seen in the drawing, during compression of the air until the extent seen at 476' (FIG. 22B), exhaust port 488*a* is blocked off by rotor A. As rotor A rotates however, under the effect of combustion, as seen in FIG. 22C, exhaust port 488*a* is uncovered so as to allow the exhaust gases to exit therethrough. Preferably, exhaust ports 488*a* and 488*b* are also provided with shutter elements, as shown and described, inter alia, in conjunction with FIGS. 1, 20A and 20B, therefore to prevent entry of gases into the engine through the exhaust ports, that might be present in the machine exhaust system, emanating from parallel working chambers sharing a common drive shaft.

It should be noted that the temperature of the exhaust gases remains high. This is especially true prior to their being exhausted from the engine housing 430 which, as described above, is made of insulative ceramic material which can withstand very high temperatures. Due to the insulative properties of the engine components and their inherent ability to withstand high temperatures, no cooling is required. As it is not possible to utilize all the excess heat energy, it is preferred to exploit this by virtue of using an external device, such as a turbo device.

Figure 22D:
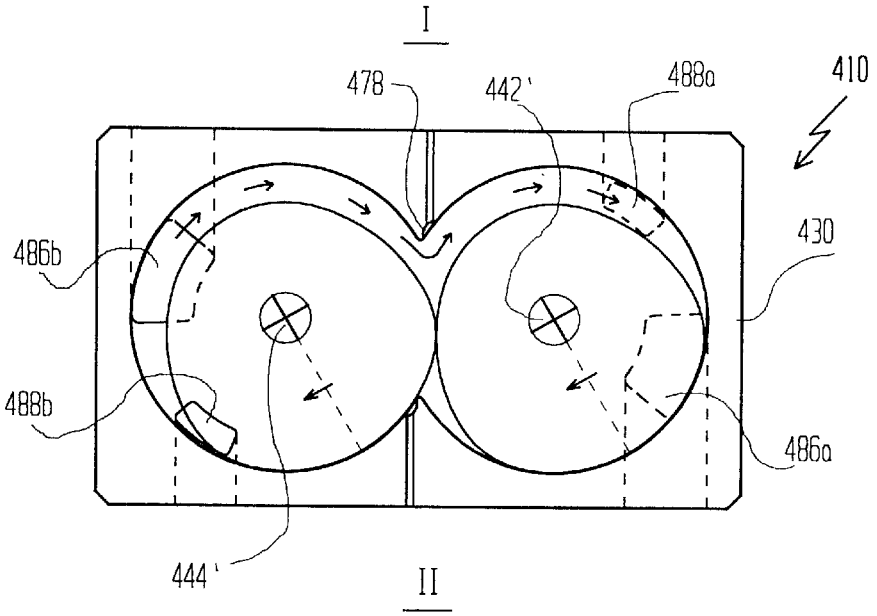

As seen in FIG. 22D, as rotor B continues to rotate, thus completely uncovering exhaust port 488*a*, substantially all of the decompressed exhaust gases are allowed to exit therethrough. While this results in substantially no gas pressure in the space 476', there remains therein burnt gas deposits which should be removed. As the rotors continue to rotate, rotor B moves away from non-joining partition wall 478, thereby, as seen in FIG. 22D, opening a passage from inlet port 486*b* to exhaust port 488*a*, via upper non-joining partition wall 478.

Accordingly, the removal of the burnt gas deposits, known as scavenging, is accomplished by admitting clean air into the passage via inlet port 486*b*, which, as indicated by the arrows, passes through the passage and exits via exhaust port 488*a*. Other methods of scavenging are discussed herein on conjunction with other embodiments of the invention.

It should be noted that, while clean air should enter engine 410 automatically via inlet port 486*b* due to the reduction in pressure created by rotation of the rotors A and B, it may be desirable to employ additional means to prevent escape of air once scavenging has finished, which would occur due to the exhaust port 488*a* still being uncovered by rotor A. The solution to this problem lies in the provision and operation of a shutter element (not shown), and which is discussed in detail in conjunction with FIGS. 24A–27, above.

Figure 23A:
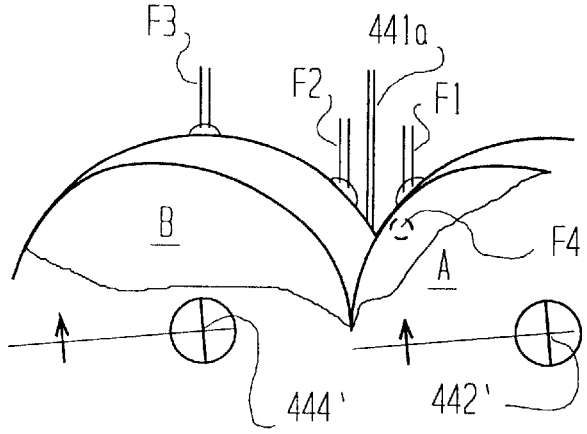
FIG. 23A is a partial, schematic, cross-sectional view of a portion of the engine depicted in FIGS. 22A–22D, showing different possible fuel injection locations.
Figure 23B:
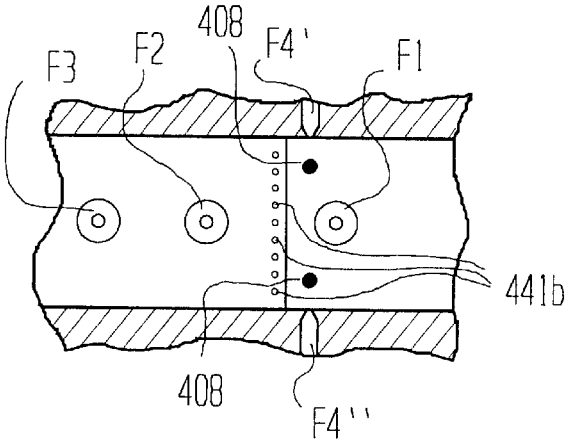
FIG. 23B is an elevational view of the engine portion seen in FIG. 23A.

With additional reference to FIGS. 23A–23B, there are seen portions of the engine 410 of FIGS. 22A–D, wherein ref. nos. F1, F2 and F3 indicate fuel inlet ports whereby fuel may be injected into the engine 410. It is important to note the position of fuel injection into the engine, as the ability to mix the injected fuel with the compressed air depends on whether the fuel is injected in a more upstream position, in which case mixing will be possible; or in a more downstream position, in which case mixing will be less possible.

As seen in FIG. 23B, injection may also be provided from above (F4'), from below (F4") or from above and below. As discussed above in conjunction with FIGS. 10A and 10B, in order to prevent the possibility of combustion occurring in the combustion chamber earlier than desired, due to a fuel-air mixture being brought into contact with a very hot surface portion of a leading rotor, a gas screen may be provided immediately upstream of the rotor, thereby delaying contact between the combustible mixture and the rotor. Typically, this screen may be provided by introducing into the combustion chamber streams of pressurized gas, preferably air, via nozzles 441*b*.

As an alternative, the engine may be constructed so as to provide a lower compression ratio, such as 1:14, thereby avoiding premature ignition. However, in order to assist in ignition, there may be provided hot points such as glow plugs or permanent spark plugs, as shown at 408.

It will be appreciated by persons skilled in the art, that the fuel injection location significantly affects the nature of the fuel-air mixture, its point of combustion, and thus the operation of the engine.

By way of example, injection of fuel as discussed above in conjunction with FIG. 22B, at location 440, will give rise to engine activity which is similar to that of a diesel engine having rising and falling pistons, in relation to fuel and air mixing during the portion of the piston cycle where air is drawn into the chamber. A disadvantage associated with this type of engine activity is that the fuel and air do not have the opportunity to properly mix, as is also the case with piston-powered diesel engines. This results in relatively low power output, thus requiring diesel engines to be 20% larger than gasoline engines in order to supply the same power output.

An alternative, however, is to inject fuel into the working chamber 476 (FIG. 22A) of engine 410, via fuel inlet port F3 (FIGS. 23A and 23B). At this portion of the cycle of rotor B, space 476 does not contain hot air, as the air has not yet been compressed. Thus, the fuel and air are allowed to mix, and thereafter, as the rotors continue to rotate, the fuel-air mixture is heated during compression.

In order to ensure that the resulting fuel-air mixture is ignited at the right time during the cycle, there are several options. For example, the fuel may be ignited by a spark from electrodes 408 (FIG. 23B). In order to ensure that the fuel does not ignite prematurely, due to contact with the hot rotor B, there may be provided at least one cool air inlet port 441*a* (FIG. 23A) which allows cool air to enter via apertures 441*b* (FIG. 23B), thus providing a barrier between the fuel-air mixture and the hot rotor A.

A further possibility is to inject the fuel via fuel inlet port F2 (FIGS. 23A and 23B), which results in better mixing of the fuel and air within working chamber 476 (FIG. 22A). It should be noted that, within chamber 476, the temperature of the fuel-air mixture is much higher than that required for fuel ignition. Proper mixing and burning of the fuel and air is important for several reasons. First, this reduces contamination of the engine which would otherwise result from incomplete burning of the fuel. Such contamination is known in diesel engines, wherein insufficient mixing of the fuel and air results in the creation of solid waste particles in the exhaust. Proper mixing and burning of the fuel and air in the engine according to the present invention overcomes these disadvantages, as discussed above.

Referring now to FIGS. 24A–27, engine 410 is illustrated in conjunction with a shutter element, whose function is substantially as shown and described above in conjunction with FIGS. 1, 20A and 20B. Accordingly, these drawings are described only in so far as operation of the shutter elements is concerned.

Figure 24A:
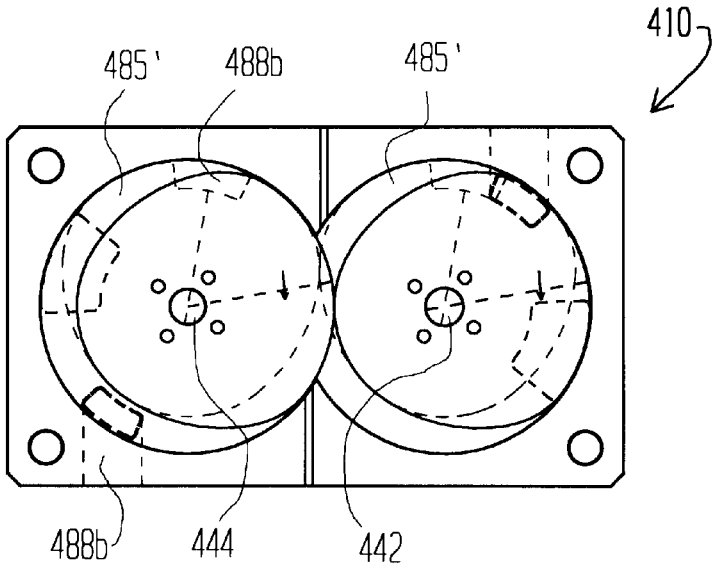
FIGS. 24A and 24B are schematic cross-sectional views of the machine of FIG. 1, taken along line X—X therein, and showing the different positions of the rotors during different stages of operation, and wherein the machine of the invention is constructed as an ICE, and wherein non-circular shutter elements are also employed, in accordance with an additional embodiment of the invention.
Figure 24B:
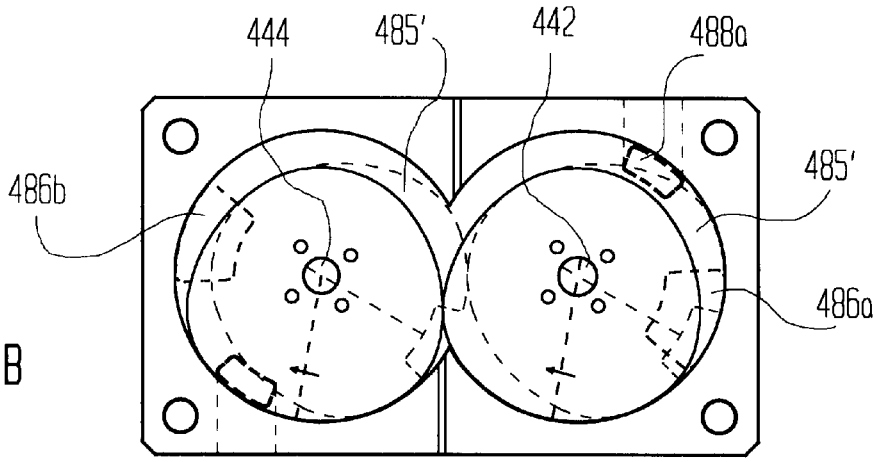
Figure 25:
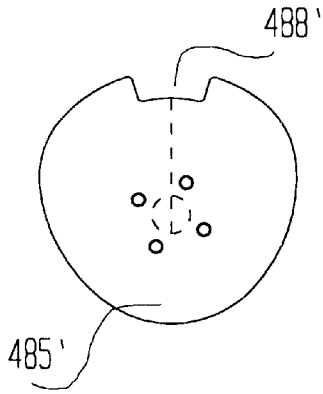
FIG. 25 is a schematic representation of a non-circular shutter element seen in FIGS. 24A and 24B.

Referring initially to FIGS. 24A and 24B, engine 410 is seen to employ a shutter element 485', shown also in FIG. 25, which has a geometrical configuration which is similar to that of the rotors as described herein, except for the provision of a cut out 488' (FIG. 25). As seen from the two exemplary positions of the rotors in FIGS. 24A and 24B, each shutter element 485' is mounted onto a respective rotor shaft 442, 444 so as to rotate together with the rotor mounted thereon in a fixed angular displacement therefrom, so as to alternately cover and uncover the air inlet ports 486*a* and 486*b*, and the exhaust ports 488*a* and 488*b*, generally as described above. Cut-out 488' is provided so as to facilitate proper exhausting of combustion gases, when required.

Figure 26A:
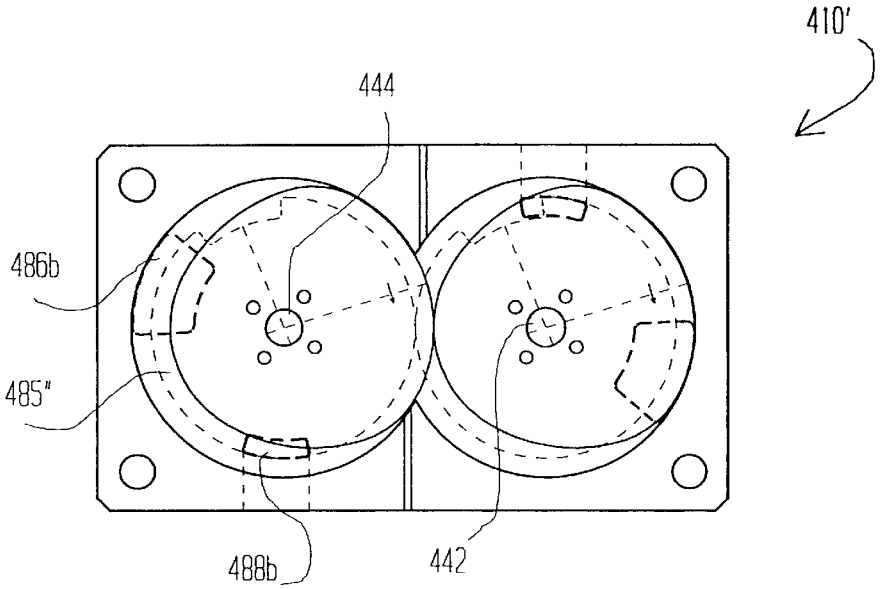
FIGS. 26A and 26B are schematic cross-sectional views of the machine of FIG. 1, taken along line X—X therein, and showing the different positions of the rotors during different stages of operation, and wherein the machine of the invention is constructed as an ICE, and wherein circular shutter elements are also employed, in accordance with yet a further embodiment of the invention.
Figure 26B:
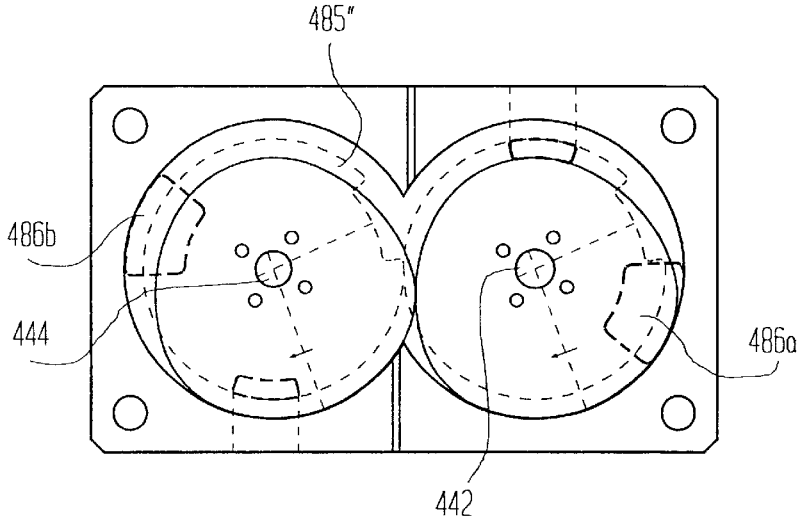
Figure 27:
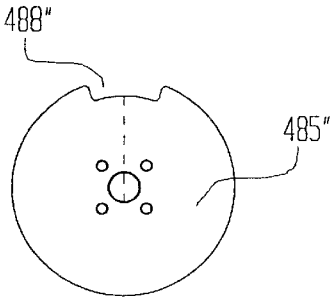
FIG. 27 is a schematic representation of a circular shutter element seen in FIGS. 26A and 26B.

Referring now to FIGS. 26A and 26B, engine 410' is seen to employ a shutter element 485', shown also in FIG. 27, which is cylindrical, and in which there is also formed a cut out 488". As seen from the two exemplary positions of the rotors in FIGS. 24A and 24B, each shutter element 485' is mounted onto a respective rotor shaft 442, 444 so as to rotate together with the rotor mounted thereon in a fixed angular displacement therefrom, so as to partially cover and uncover the air inlet ports 486*a* and 486*b*, and so as to completely cover the exhaust ports 488*a* and 488*b*, generally as described above. Cut-out 488' is provided so as to facilitate proper exhausting of combustion gases, when required.

As described above in conjunction with FIG. 22D, the space in which the fuel is burned may be cleaned by allowing an air flow therethrough. Waste particles suspended in the exhaust gases may, nonetheless, remain, due to an insufficiency in the air pressure between the inlet port 486*b* and exhaust port 488*a*. This problem would clearly be compounded, in an engine that includes more than one row of rotors which rotate on the same axes. By way of explanation, in an engine constructed in accordance with the present invention, and having two or more sets of rotors, a first one of outlets 488 may be under the pressure of exhaust gases exiting a similar parallel, second one of outlets 488 while the rotors associated therewith are in a different phase of their cycle. Thus, instead of cleaning the engine, waste from the space above the adjacent rotors may actually contaminate the working chamber of an adjacent rotor housing.

Figure 28A:
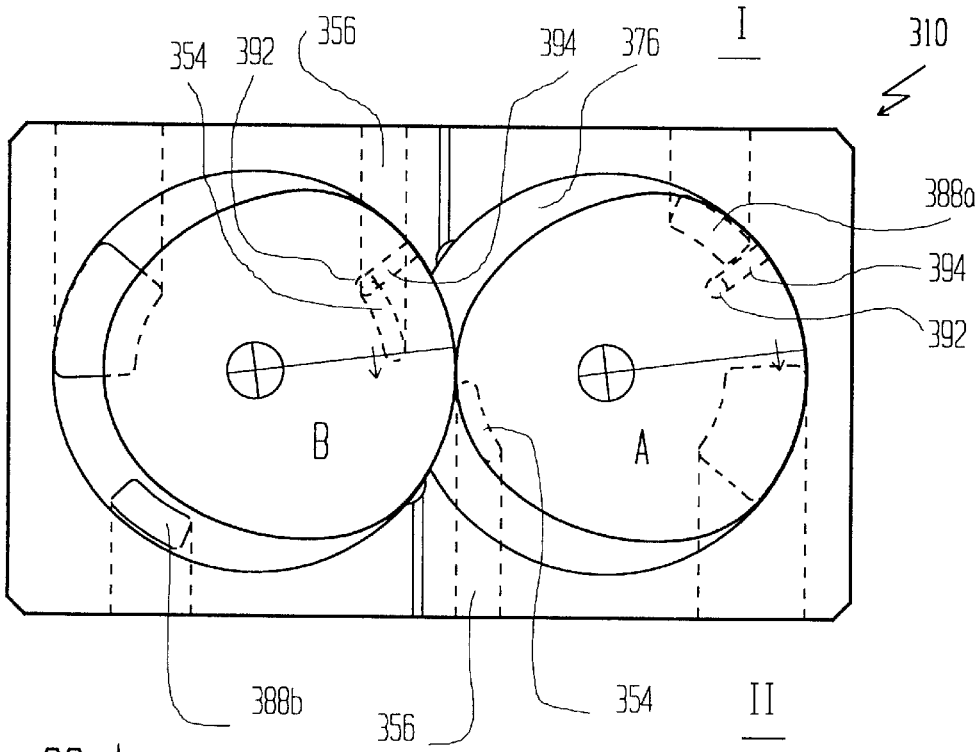
FIGS. 28A and 28B are schematic cross-sectional views of the machine of FIG. 1, taken along line X—X therein, illustrating an inlet/outlet arrangement providing scavenging in accordance with a further embodiment of the invention.
Figure 28B:
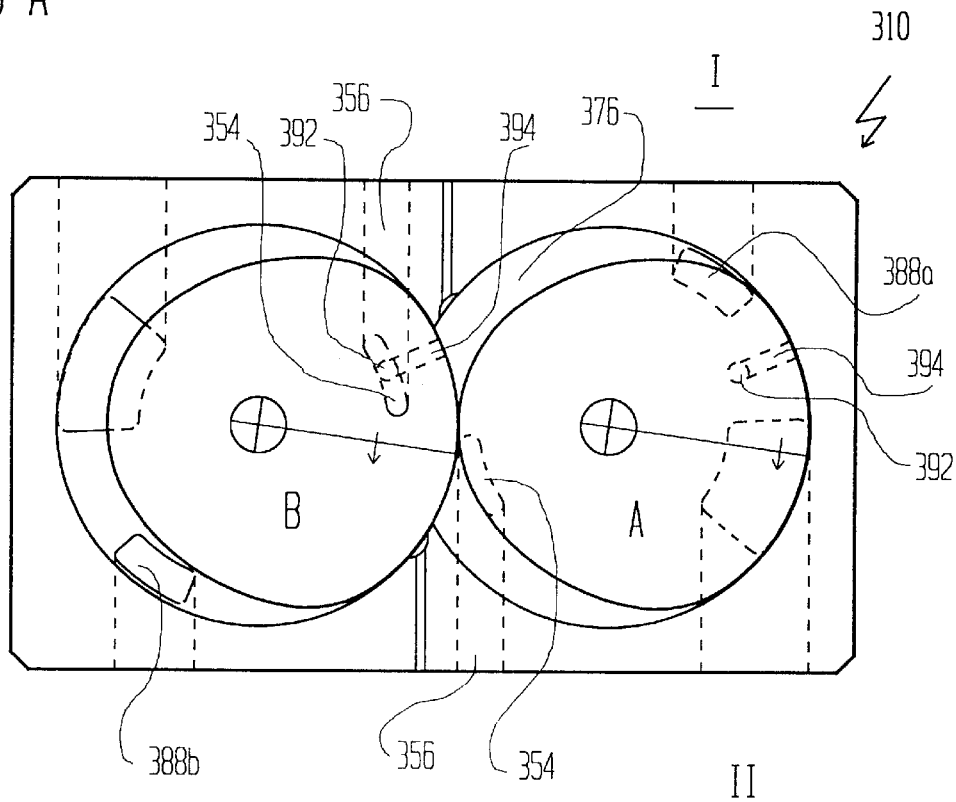

Referring now to FIGS. 28A–28B, there is shown an engine which is a diesel engine similar to engine 410, shown and described above in conjunction with FIGS. 22A–D, but with the addition of a device for the injection of pressurized air into the engine. This device may be utilized, as described hereinbelow, for the purpose of aiding in the expulsion of the exhaust gases from the engine, at specific phases of the rotor cycle. It is to be understood that such a method is not to be limited to use in the diesel engine discussed herein. Rather, this method may be used as a general purpose method for improving engine cleaning and as a method for preventing undesired mixing of gases, as discussed herein.

As seen in FIGS. 28A–28B, engine 310 includes rotors B and A, in each of which is provided a main, inlet bore 392, and a plurality of outlet bores 394, substantially as described above in conjunction with FIG. 15. The position of the inlet bores 392 is so as not to interfere with the operation of the rotor, at any phase of the cycle thereof. Engine 310 is also provided with a compressed air inlet duct 356 and an inlet 354 via which compressed air may be provided from a suitable source (not shown).

Rotors B and A are shown in FIG. 28*a* at the portion of their cycle at which rotor A is beginning to uncover exhaust port 388*a*, such that exhaust gases within space 376 begin to exit therefrom via outlet 388*a*. At exactly the same time, main inlet bore 392 of rotor B begins to come into registration with inlet 354 of duct 356. A further rotation of rotor B increases the flow of air via duct 356, inlet 354, main inlet bore 392, and outlet bores 394 into space 376, so as to supply a stream of compressed air thereinto thus increasing the flow of exhaust gases therefrom, via exhaust port 388*a*.

As rotation continues, and rotors B and A are oriented such that the gas pressure in space 376 is greatly reduced, as shown in FIG. 28B, the orientation of main inlet bore 392 with space 376 is such that the inflow of air via duct 356, inlet 354, and main inlet bore 392 is maximized, so as to maximize the emission of gas particles from space 376 via exhaust port 388*a*. This is due to the fact that, at this position, the path of air is shortest from inlet 354 to exhaust port 388*a*. Further rotation of the rotors B and A reduces the flow of air from inlet 354 to exhaust port 388*a*, until the rotors reach the position in which they block off inlet 354 completely. The cleaning cycle will be repeated twice during each complete cycle of the rotors, first, as discussed above, when main inlet bore 392 of rotor B comes into registration with inlet 354 adjacent rotor B, and second when main inlet bore 392 of rotor A comes into registration with inlet 354 adjacent rotor A.

It will be appreciated by persons skilled in the art that the scope of the present invention is not limited by what has been shown and described hereinabove. Rather, the scope of the present invention is limited solely by the claims, which follow.

What is claimed is:

1. For use with a rotary machine, a rotor which includes:

a pair of parallel side surfaces; and a curved perimeter surface formed between said pair of parallel side surfaces, formed of a plurality of curved portions, each abutted by a pair of said curved portions, contiguous therewith and mutually tangential thereto wherein said curved perimeter surface further comprises:

a major portion defining a first major arc subtending a predetermined angle at a predetermined center of rotation, and having a first radius;

a minor portion defining a first minor arc subtending a predetermined angle at the predetermined center of rotation, and having a second radius, shorter than said first radius, said major and minor arcs being arranged along an axis of symmetry; and a pair of similar, intervening curved portions extending tangentially between major and minor arcs;

wherein each of said pair of intervening curves is formed of a second major arc and a second minor arc of predetermined radii;

wherein said curved perimeter surface is shaped such that when mounted for coplanar, non-touching, and same-directional rotation with another rotor of identical construction, and wherein said rotors have mutually parallel orientations at the start of rotation, and are rotated at the same angular velocity, said curved perimeter surface of said rotor is separated from the curved perimeter surface of the other rotor by a predetermined, fixed distance and wherein each said rotor has a geometric center, and the distance therebetween equals R1+R2, wherein R1 is the radius of said first major arc and R2 is the radius of said first minor arc.

2. A rotor A for use in a rotary machine in cooperation with an identical rotor B, rotors A and B having respective centers of rotation $P_A$ and $P_B$, wherein said rotor A is adjacent and in parallel orientation to rotor B and includes:

a) a pair of parallel side surfaces spaced apart by the thickness of said rotor; and b) a curved perimeter surface formed between said pair of parallel side surfaces, formed of a plurality of curved portions JK, Ke', e'L, LM, Me", and e"J, each said curved portion being contiguous with and mutually tangential with a pair of said curved portions, and wherein 1) said curved portion JK is a first major segment S1 defining a first major arc A1 subtending an angle $\alpha$ at the center of rotation $P_A$, and having a first radius R1; and 2) said curved portion LM is a first minor segment S2 defining a first minor arc A2 subtending the angle $\alpha$ at the center of rotation $P_A$, and having a second radius R2, shorter than the first radius R1, said rotor having an axis of symmetry bisecting said major and minor segments $S_1$ and S2, and wherein R1+R2 equals the height of said rotor measured along its axis of symmetry, which equals the distance D between the centers of rotation $P_A$ and $P_B$;

3) said curved portions e'L and Me" are major arcs each having a radius R extending from origins $O_2$ and $O_1$, respectively;

4) said curved portions Ke' and e"J are minor arcs each having a radius r extending from origins $O_1$ and $O_2$, respectively; wherein, when said rotor A is adjacent and in parallel orientation to rotor B and such that the distance between the centers of rotation $P_A$ and $P_B$=D, origins $O_1$ and $O_2$ are respectively located at the intersection points of the line EE which is parallel to a line extending through the centers of rotation $P_A$ and $P_B$; and 5) wherein the distance of the line EE from the line $P_AP_B$ is determined by positioning said line EE at a point D' located along a perpendicular bisector VV of line $P_AP_B$ at a point D', the location of point D' being determined by bisecting the angle between $P_AP_B$ and $P_AJ$ so as to obtain the line $P_AC$, and extending a normal from point J to the line $P_AC$, and extending it so as to intersect the line VV at the point D'.

3. An improved rotary machine which includes:

a housing having formed therein a generally elongate cavity, said cavity being formed by a pair of adjoining, partially overlapping cylindrical bores, each said bore being separated from an adjoining bore by a pair of non-joining partition walls;

a pair of non-cylindrical rotors arranged in said pair of adjoining bores, each said rotor having a curved outer surface formed of a plurality of contiguous mutually tangential curved portions, wherein each said rotor is disposed in one of said bores for synchronized, non-touching and same-directional rotation with the other of said pair of rotors;

a pair of rotor shafts associated with each said pair of rotors, each said rotor shaft extending through one of said bores, and mounted transversely to each said rotor so as to provide eccentric rotation thereof in said bore;

a gear assembly and a driver associated with said rotor shafts, said assembly and said driver, cooperating to provide synchronized same directional rotation of said rotor shafts; and a plurality of gas ports formed in said housing and communicating with said elongate cavity thereof, for permitting selectable intake and exhaust of working gases, wherein, introduction of a working gas into interactive association with said rotors causes rotation of said pair of rotors and thus also of said driver, wherein each said bore has a geometric center, and each said rotor is mounted for rotation about a rotation axis spaced from said geometric center by a predetermined eccentricity;

each said cavity is bounded by a pair of parallel wall surfaces transverse to said rotation axis;

said plurality of gas ports includes at least a pair of gas ports provided in communication with each said bore, wherein a first of said gas ports is arranged at a first radius from said geometric center and a second of said gas ports is arranged at a second radius from said geometric center, wherein said second radius has a magnitude smaller than that of said first radius; and wherein each said rotor is operative to rotate within one of said bores so as to periodically uncover said first port, thereby to enable a flow therethrough of a working gas and wherein each said rotor has a pair of flat, parallel surfaces disposed in dynamic, non-touching, sealing relation with said pair of parallel wall surfaces of each said cavity, and each said rotor has formed therein a throughflow portion which is formed so as to be brought periodically into communicative association with the interior of said cavity and with said second gas port, so as to facilitate gas communication therebetween.

4. A machine according to claim 3, wherein said pair of rotors are disposed in substantially equal angular orientation relative to said rotation axes thereof.

5. A machine according to claim 3, wherein said machine is a motor, associable with an external source of pressurized working gas, wherein each said bore has a geometric center, and each said rotor is mounted for rotation about a rotation axis spaced from said geometric center by a predetermined eccentricity;

each said cavity is bounded by a pair of parallel wall surfaces transverse to said rotation axis;

said plurality of gas ports includes at least a pair of gas ports provided in each said bore, wherein a first of said gas ports is arranged at a first radius from said geometric center and a second of said gas ports is arranged at a second radius from said geometric center, wherein said second radius has a magnitude larger than that of said first radius; and wherein each said rotor is operative to rotate within one of said bores so as to periodically uncover said second port, thereby to enable a flow therethrough of a working gas.

6. A machine according to claim 5, wherein each said rotor has a pair of flat, parallel surfaces disposed in dynamic, non-touching, sealing relation with said pair of parallel wall surfaces of each said cavity, and each said rotor has formed therein a throughflow portion which is formed so as to be brought periodically into communicative association with the interior of said cavity and with said first gas port, so as to facilitate gas communication therebetween.

7. A machine according to claim 6, wherein each said pair of rotors includes first and second rotors, each arranged for rotation within a predetermined pair of adjoining, respective, first and second bores such that said outer surfaces of said first and second rotors are always in dynamic, non-touching, sealing relation with each other.

8. A machine according to claim 7, wherein said first port is a pressurized working gas intake port, and said second port is a working gas exhaust port.

9. A machine according to claim 3, wherein said machine is a compressor, associable with an external source of working gas, wherein each said bore has a geometric center, and each said rotor is mounted for rotation about a rotation axis spaced from said geometric center by a predetermined eccentricity;

each said cavity is bounded by a pair of parallel wall surfaces transverse to said rotation axis;

said plurality of gas ports includes at least a pair of gas ports provided in each said bore, wherein a first of said gas ports is arranged at a first radius from said geometric center and a second of said gas ports is arranged at a second radius from said geometric center, wherein said second radius has a magnitude larger than that of said first radius; and wherein each said rotor is operative to rotate within one of said bores so as to periodically uncover said second port, thereby to enable a flow therethrough of a working gas.

10. A machine according to claim 9, wherein each said rotor has a pair of flat, parallel surfaces disposed in dynamic, non-touching, sealing relation with said pair of parallel wall surfaces of each said cavity, and each said rotor has formed therein a throughflow portion which is formed so as to be brought periodically into communicative association with the interior of said cavity and with said first gas port, so as to facilitate gas communication therebetween.

11. A machine according to claim 10, wherein each said pair of rotors includes first and second rotors, each arranged for rotation within a predetermined pair of adjoining, respective, first and second bores such that said outer surfaces of said first and second rotors are always in dynamic, non-touching, sealing relation with each other.

12. A machine according to claim 11, wherein said second port is a working gas intake port, and said first port is a pressurized working gas exhaust port.

13. A machine according to claim 4, wherein each said pair of rotors includes first and second rotors arranged for rotation within a predetermined pair of adjoining, respective, first and second bores such that said outer surfaces of said first and second rotors are always in dynamic, non-touching, sealing relation with each other.

14. A machine according to claim 13, wherein said machine is an internal combustion engine, and said rotors are operative, during said rotation thereof, to cooperate with said partition walls and predetermined portions of said wall surfaces so as to periodically form combustion chambers therewith, and wherein said housing and said rotors are formed of a substantially non-heat conducting material, thereby to enable an elevated temperature to be sustained within said combustion chambers during operation of said engine.

15. A machine according to claim 14, wherein said elevated temperature, once attained during operation of said engine, is sufficient to cause combustion of an air-fuel mixture in said combustion chambers, even in the absence of an air compression ratio of greater than 1:19.

16. A machine according to claim 14, wherein said substantially non-heat conducting material is a ceramic material.

17. A machine according to claim 13, wherein said first port is a working gas intake port, and said second port is a working gas exhaust port, and wherein each said pair of rotors are operative to rotate through a working cycle having first and second portions, wherein, during said first portion of said working cycle, said first and second rotors are operative to rotate into first positions whereat they are initially spaced from a first side of said cavity so as to define a first working space therewith, and said first rotor is operative to uncover said working gas intake port in said first bore thereby to admit air into said space;

said first rotors and second rotors are operative to rotate into second positions so as to reduce the volume of said first working space and thus compress the working gas therein; and said first rotors and second rotors are operative to be rotated into third positions in response to an expansion of the working gas in said first working space, and such that said second rotor is operative to bring said throughflow portion thereof into communicative association with the interior of said cavity and with said exhaust port in said second bore, so as to facilitate exhausting of working gas from said first working space, and wherein, during said second portion of said working cycle, said first and second rotors are operative to rotate into fourth positions whereat they are initially spaced from a second side of said cavity, opposite said first side of said cavity, so as to define a second working space therewith, and said second rotor is operative to uncover said working gas intake port in said second bore thereby to admit air into said second working space;

said first rotors and second rotors are operative to rotate into fifth positions so as to reduce the volume of said second working space and thus compress the working gas therein; and said first rotors and second rotors are operative to rotate into sixth positions so as to permit expansion of the working gas in said second working space, and such that said first rotor is operative to bring said throughflow portion thereof into communicative association with the interior of said cavity and with said exhaust port in said first bore, so as to facilitate exhausting of working gas from said second working space.

18. A machine according to claim 17, wherein, during said first portion of the working cycle, as said first rotors and second rotors rotate into said third positions, said first rotor is operative to uncover said intake port in said first bore, thereby to permit a throughflow between said intake port in said first bore, said first working space, said throughflow portion of said second rotor, and said exhaust port in said second bore;

and wherein, during said second portion of the working cycle, as said first rotors and second rotors rotate into said sixth positions, said second rotor is operative to uncover said intake port in said second bore, thereby to permit a throughflow between said intake port in said second bore, said second working space, said throughflow portion of said first rotor, and said exhaust port in said first bore.

19. A machine according to claim 18, wherein said machine is an internal combustion engine, said first and second working spaces are first and second combustion chambers, said working gas intake ports are air intake ports, and said working gas exhaust ports are combustion gas exhaust ports, and wherein said machine also includes at least first and second fuel injectors for injecting fuel into said first and second combustion chambers so as to provide fuel-air mixtures therein and so also as to enable combustion of the fuel-air mixtures, thereby to provide a rotational force on said second rotor during said first portion of said working cycle, and on said first rotor during said second portion of said working cycle.

20. A machine according to claim 19, and also including ignition apparatus associated with said first and second combustion chambers, for selectably igniting the fuel-air mixtures therein.

21. A method of constructing a rotor A for use in a rotary machine in cooperation with an identical rotor B, rotors A and B having respective centers of rotation $P_A$ and $P_B$, wherein rotor A is adjacent and in parallel orientation to rotor B and includes:

a) providing a pair of parallel side surfaces spaced, thereby to define a thickness of the rotor; and b) forming between said pair of parallel side surfaces a curved perimeter surface which includes a plurality of curved portions JK, Ke', e'L, LM, Me", and e"J, each said curved portion being contiguous with and mutually tangential with a pair of said curved portions, and including the following sub-steps:

forming said curved portion JK as a first major segment S1 which defines a first major arc A1 subtending an angle $\alpha$ at the center of rotation $P_A$, and so as to have a first radius R1; and forming said curved portion LM as a first minor segment S2 which defines a first minor arc A2 subtending the angle $\alpha$ at the center of rotation PA, and so as to have a second radius R2, shorter than the first radius R1, and such that the rotor has an axis of symmetry bisecting said major and minor segments S1 and S2, and wherein R1+R2=D which equals the height of said rotor measured along its axis of symmetry, and the distance between the centers of rotation PA and PB when rotors A and B are arranged in adjacent positions;

bisecting the angle between $P_AP_B$ and $P_AJ$ so as to obtain the line $P_AC$;

extending a normal from point J to the line $P_AC$, such that it intersects with a perpendicular bisector VV of line $P_AP_B$ at a point D';

extending a line EE through point D' parallel to the line $P_AP_B$ such that said line EE intersects with lines KM and JL respectively, at respective origin points $O_1$ and $O_2$;

extending radii R and r from each of origin points O1 and O2;

forming said curved portions e'L and Me" as major arcs each having a radius R extending from origins O1 and O1, respectively; and forming said curved portions Ke' and e"J as minor arcs each having a radius r extending from origins $O_1$ and $O_2$, respectively; wherein, when said rotor A is adjacent and in parallel orientation to rotor B and such that the distance between the centers of rotation $P_A$ and $P_B$=D, wherein said curved portions e'L and Ke' intersect with line EE at point e', so as to be contiguous and mutually tangential thereat, and the curved portions Me" and e"J intersect with line EE at point e", so as to be contiguous and mutually tangential thereat.

* * * * *